US009849398B2

(12) United States Patent
Saigo et al.

(10) Patent No.: US 9,849,398 B2
(45) Date of Patent: Dec. 26, 2017

(54) TOY BLOCK

(71) Applicant: KAWADA CO., LTD., Shinjuku-ku, Tokyo (JP)

(72) Inventors: Takeru Saigo, Tokyo (JP); Shinichi Yanagida, Tokyo (JP)

(73) Assignee: Kawada Co., LTD., Tokyo (JP)

( * ) Notice: Subject to any disclaimer, the term of this patent is extended or adjusted under 35 U.S.C. 154(b) by 0 days.

(21) Appl. No.: 14/407,030

(22) PCT Filed: Dec. 15, 2012

(86) PCT No.: PCT/JP2012/082585
§ 371 (c)(1),
(2) Date: Dec. 10, 2014

(87) PCT Pub. No.: WO2013/186955
PCT Pub. Date: Dec. 19, 2013

(65) Prior Publication Data

US 2015/0174502 A1 Jun. 25, 2015

(30) Foreign Application Priority Data

Jun. 13, 2012 (JP) ..... 2012-134281

(51) Int. Cl.
*A63H 33/08* (2006.01)
*A63H 33/04* (2006.01)

(52) U.S. Cl.
CPC ..... *A63H 33/08* (2013.01); *A63H 33/04* (2013.01); *A63H 33/086* (2013.01)

(58) Field of Classification Search
CPC ..... A63H 33/04; A63H 33/06; A63H 33/062; A63H 33/065; A63H 33/08; A63H 33/086; A63H 33/10; A63H 33/101; A63H 33/102
See application file for complete search history.

(56) References Cited

U.S. PATENT DOCUMENTS 3,162,973 A * 12/1964 Christiansen ..... A63H 33/086 446/128
3,415,007 A * 12/1968 Hëwe ..... A63H 33/042 446/102

(Continued)

FOREIGN PATENT DOCUMENTS

CA 1046767 A1 * 1/1979
CH 495 762 A 9/1970

(Continued)

OTHER PUBLICATIONS

International Search Report for application No. PCT/JP2012/082585, dated Feb. 5, 2013.

(Continued)

*Primary Examiner* — Gene Kim
*Assistant Examiner* — Alyssa Hylinski
(74) *Attorney, Agent, or Firm* — Knobbe, Martens Olson & Bear LLP

(57) ABSTRACT

The present invention includes: a base section configured such that, taking the unit edge length D1 to be 1 and a cube expressed as 1×1×1 to be one unit size, the base section has a parallelepiped shape in which one or more 1-unit sizes are conjoined, and is composed of an open, hollow face taken to be the bottom, four lateral walls 3B, and a roof 3A; and cylindrical projections having a cylindrical shape and provided on the outer face of one or more of the roof 3A and the lateral walls 3B, with a diameter D2 being equal to or greater than 0.4 but less than 0.6 with respect to the unit edge length D1, and a height being (1−diameter)×(0.4 to 0.5 inclusive).

9 Claims, 19 Drawing Sheets

CONFIGURATION OF 8-UNIT BLOCK ACCORDING TO THIRD EMBODIMENT

(56) References Cited

U.S. PATENT DOCUMENTS

| | | | | | |
|---|---|---|---|---|---|
| 3,566,531 | A * | 3/1971 | Hasel | A63H 33/062 446/120 |
| 4,744,780 | A | 5/1988 | Volpe | |
| 5,471,808 | A | 12/1995 | De Pieri et al. | |
| 6,050,873 | A * | 4/2000 | Reisman | A63H 33/062 446/121 |
| 6,645,033 | B1 * | 11/2003 | Thomsen | A63H 33/086 446/120 |
| 8,105,128 | B1 * | 1/2012 | Sorensen | A63H 33/086 446/122 |
| 2011/0045733 | A1 * | 2/2011 | Saigo | A63H 33/086 446/125 |
| 2013/0252504 | A1 * | 9/2013 | Chang | A63H 33/086 446/124 |
| 2014/0220854 | A1 * | 8/2014 | Lee | A63H 33/088 446/120 |

FOREIGN PATENT DOCUMENTS

| | | | | |
|---|---|---|---|---|
| CN | 101791481 | | 8/2010 | |
| EP | 0 596 371 | A1 | 5/1994 | |
| FR | 1 415 559 | A | 10/1965 | |
| GB | 2 118 447 | A | 11/1983 | |
| GB | 2118447 | A * | 11/1983 | A63H 33/086 |
| JP | S52-71799 | U | 5/1977 | |
| JP | 05-277262 | | 10/1993 | |
| JP | 05277262 | A * | 10/1993 | |
| JP | 2010-172568 | | 8/2010 | |
| WO | WO 2010/087037 | | 8/2010 | |

OTHER PUBLICATIONS

The extended European search report mailed by European Patent Office dated Feb. 12, 2016 in the corresponding European Patent Application No. 12878811.4—10 pages.

* cited by examiner

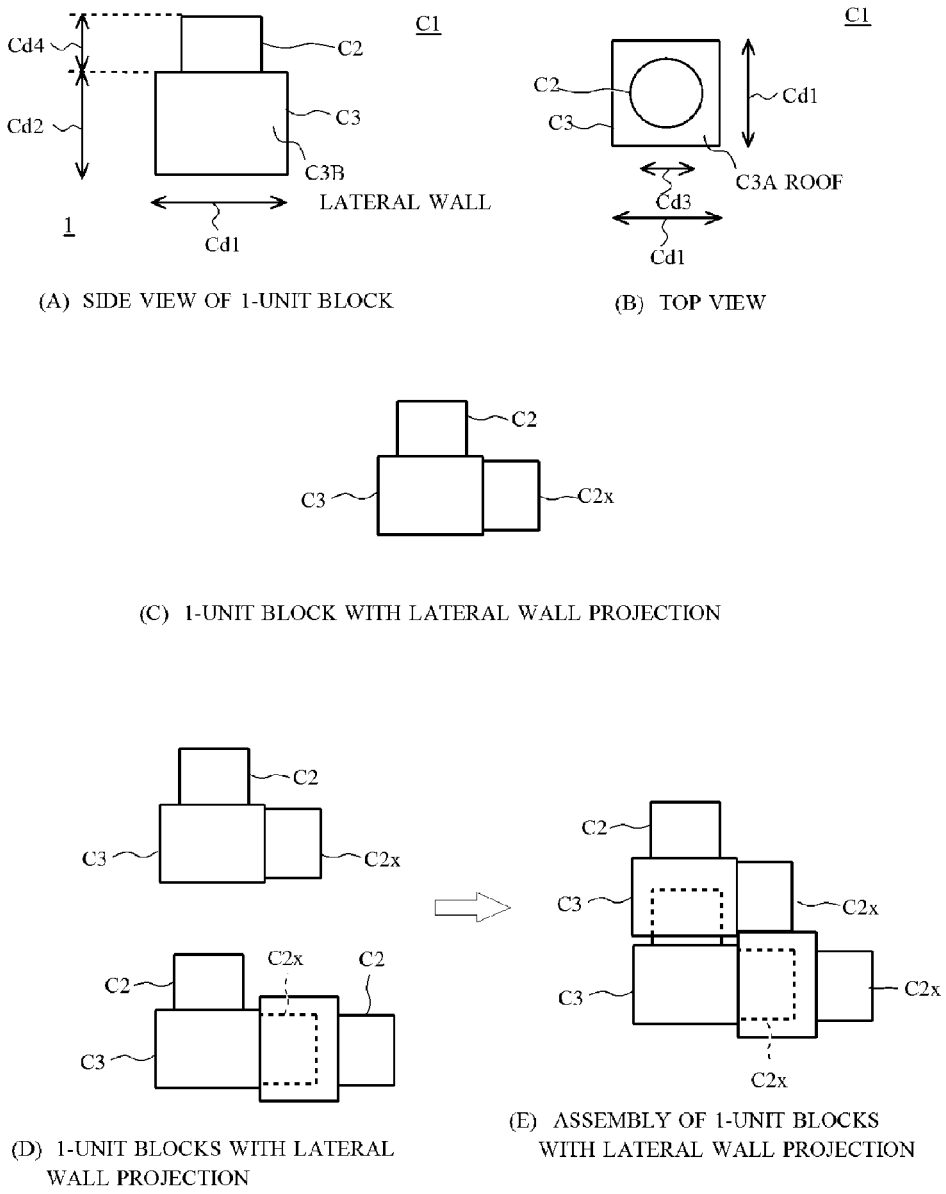
FIG. 1 CONFIGURATION OF CONVENTIONAL 1-UNIT BLOCK

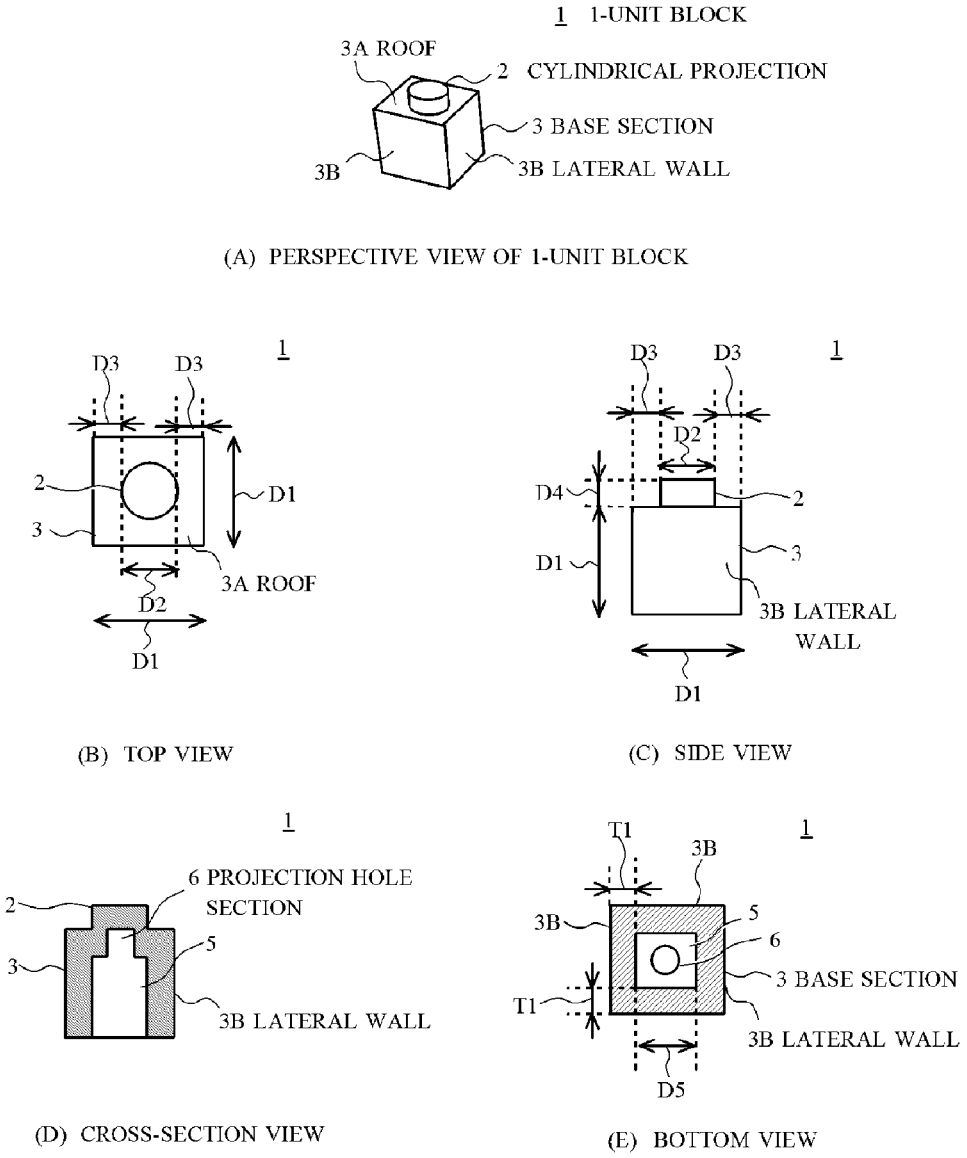
FIG. 2 CONFIGURATION OF 1-UNIT BLOCK ACCORDING TO FIRST EMBODIMENT

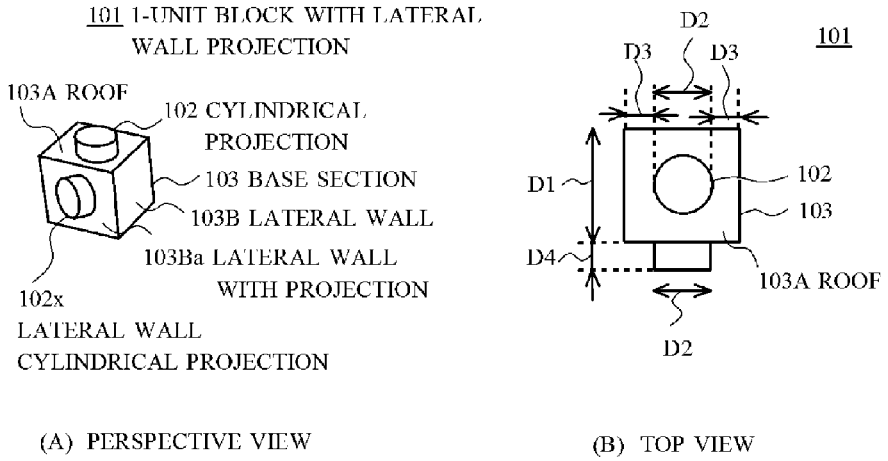
FIG. 3 CONFIGURATION OF 1-UNIT BLOCK WITH LATERAL WALL PROJECTION ACCORDING TO FIRST EMBODIMENT

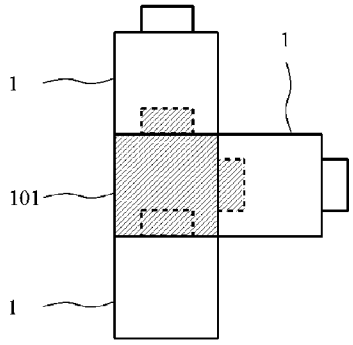
(A) ASSEMBLY OF 1-UNIT BLOCK WITH LATERAL WALL PROJECTION
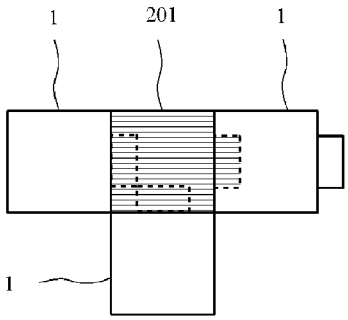
(B) ASSEMBLY OF 1-UNIT BLOCK WITH LATERAL WALL HOLE
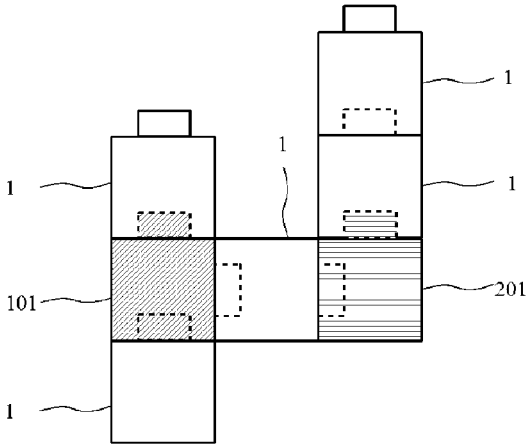
(C) VARIOUS COMBINATIONS
FIG. 4 ASSEMBLY OF 1-UNIT BLOCK ACCORDING TO FIRST EMBODIMENT

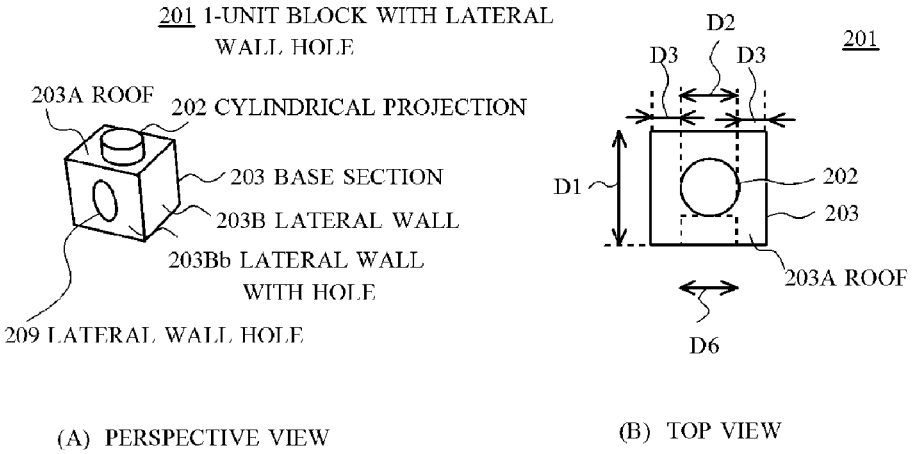
FIG. 5 CONFIGURATION OF 1-UNIT BLOCK WITH LATERAL WALL HOLE ACCORDING TO FIRST EMBODIMENT

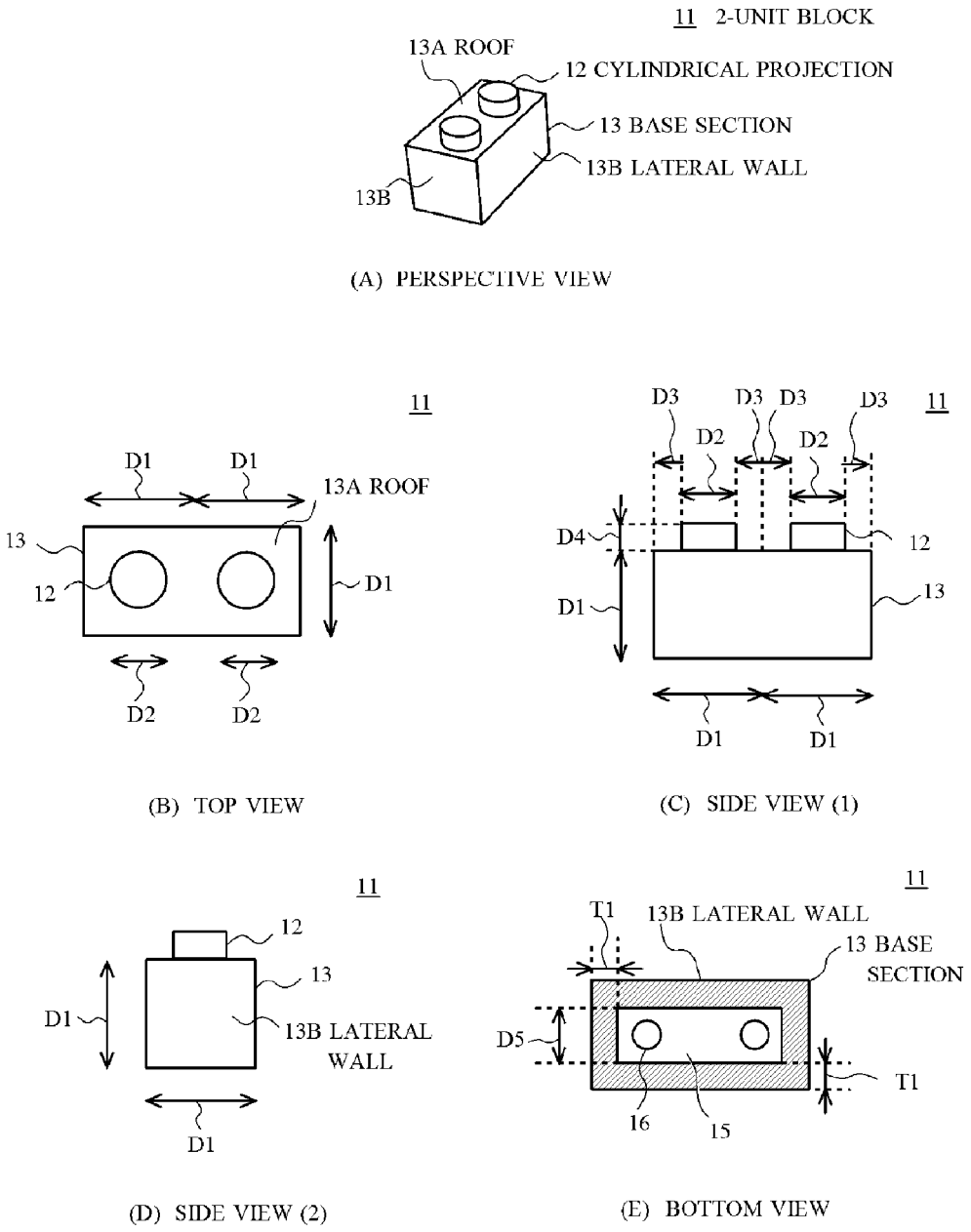
FIG. 6 CONFIGURATION OF 2-UNIT BLOCK ACCORDING TO FIRST EMBODIMENT

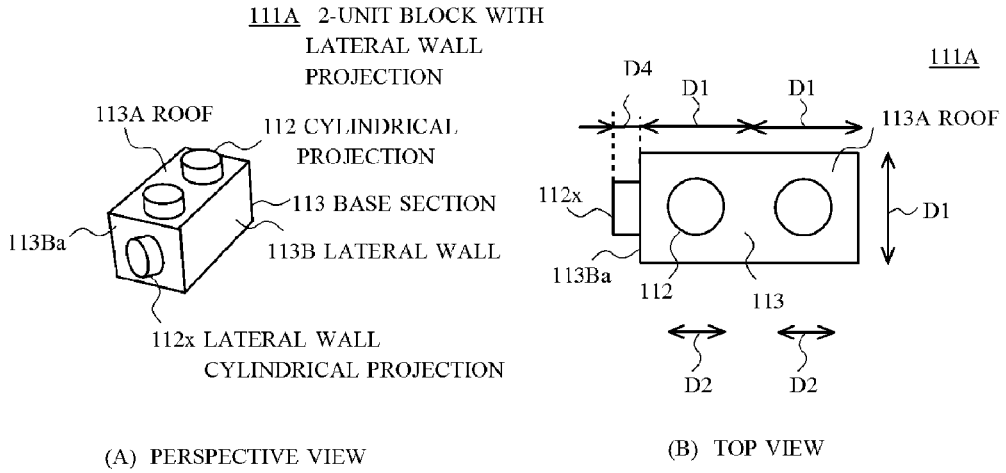
FIG. 7 CONFIGURATION (1) OF 2-UNIT BLOCK WITH LATERAL WALL PROJECTION ACCORDING TO FIRST EMBODIMENT
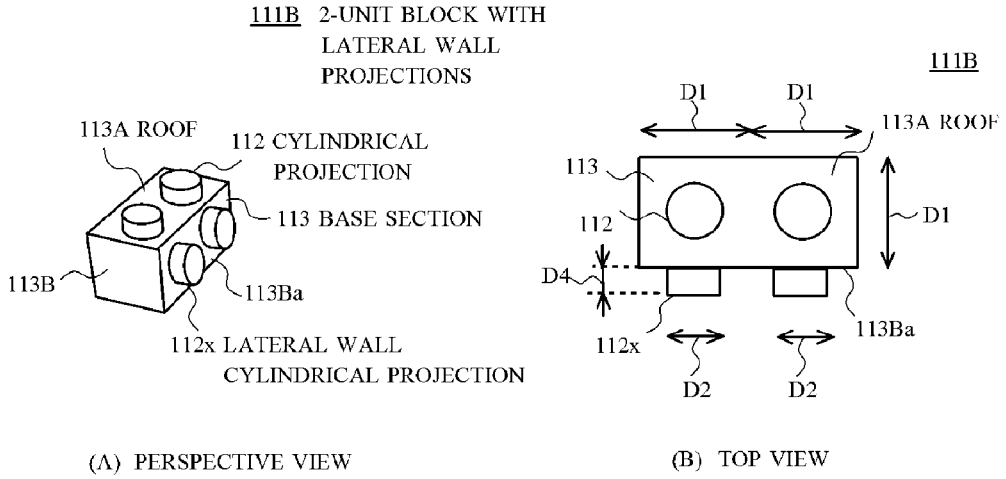
FIG. 8 CONFIGURATION (2) OF 2-UNIT BLOCK WITH LATERAL WALL PROJECTIONS ACCORDING TO FIRST EMBODIMENT

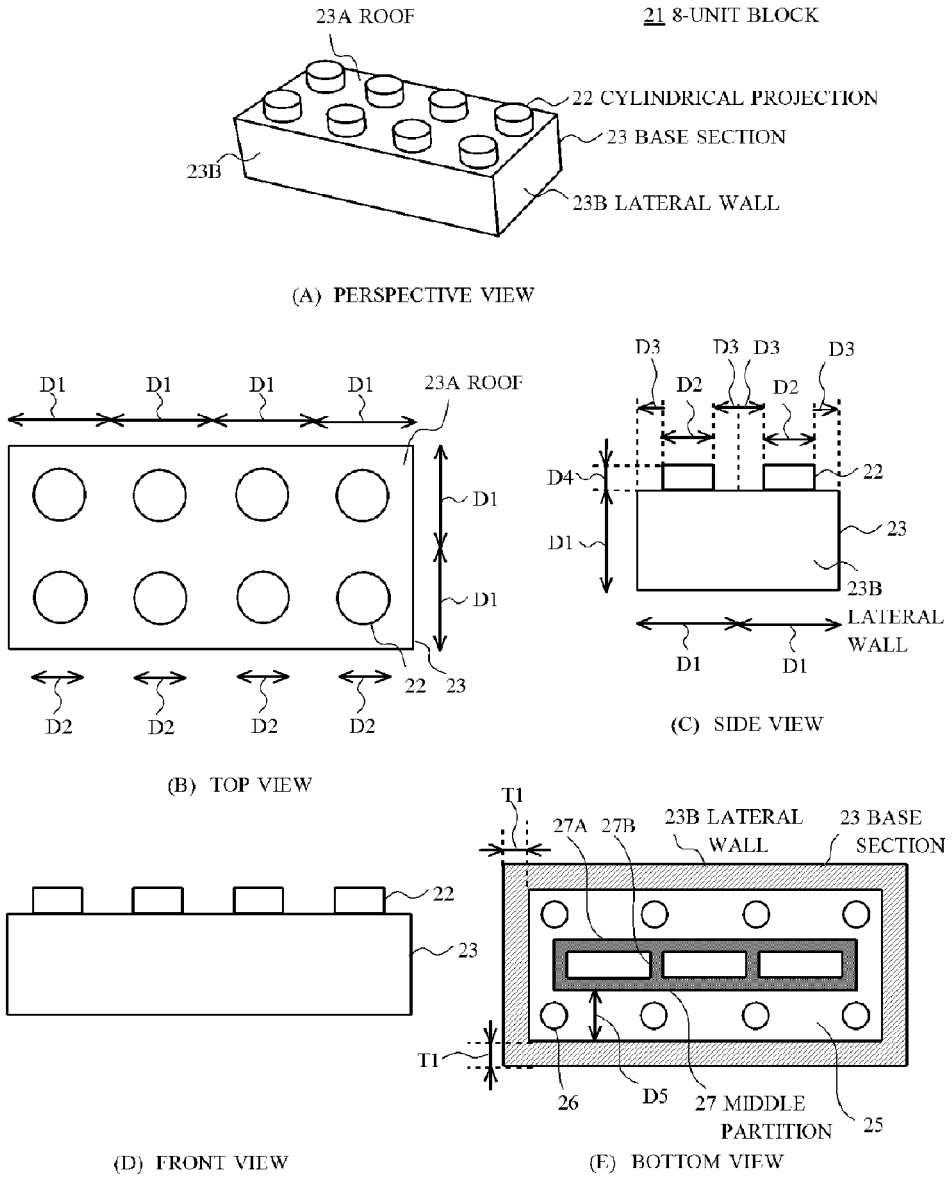
FIG. 9 CONFIGURATION (1) OF 8-UNIT BLOCK ACCORDING TO FIRST EMBODIMENT

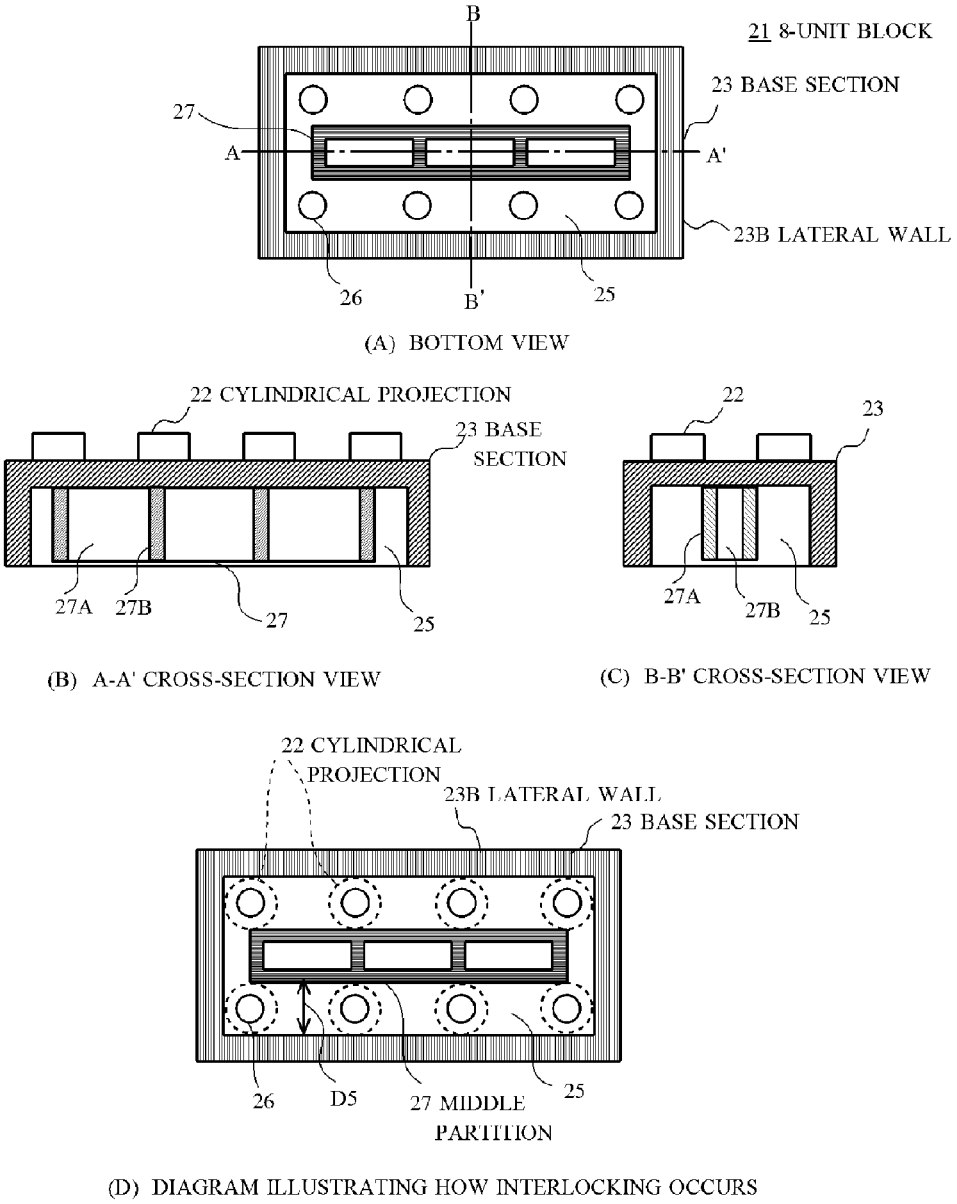
FIG. 10 CONFIGURATION (2) OF 8-UNIT BLOCK ACCORDING TO FIRST EMBODIMENT

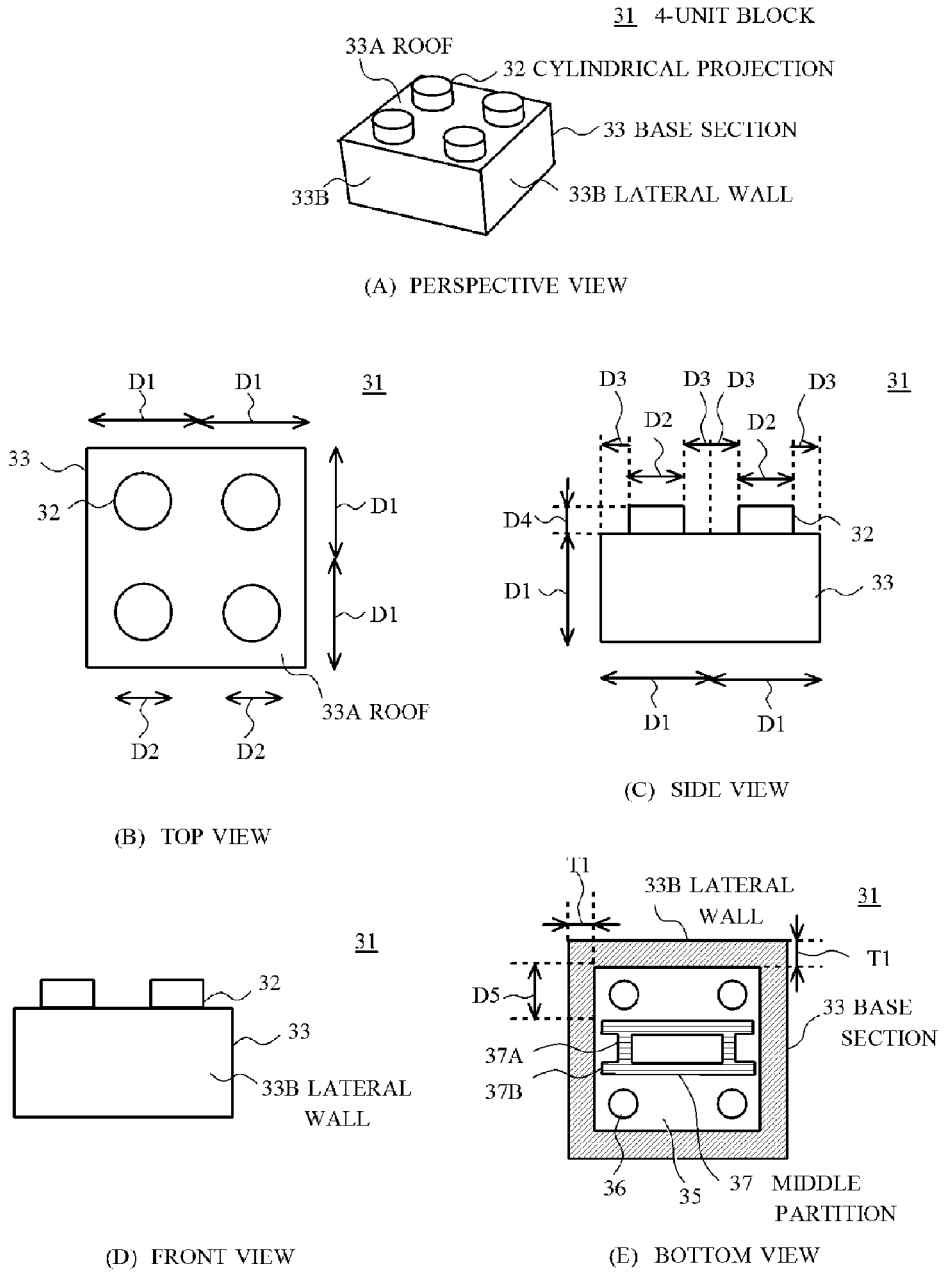
FIG. 11 CONFIGURATION OF 4-UNIT BLOCK ACCORDING TO FIRST EMBODIMENT

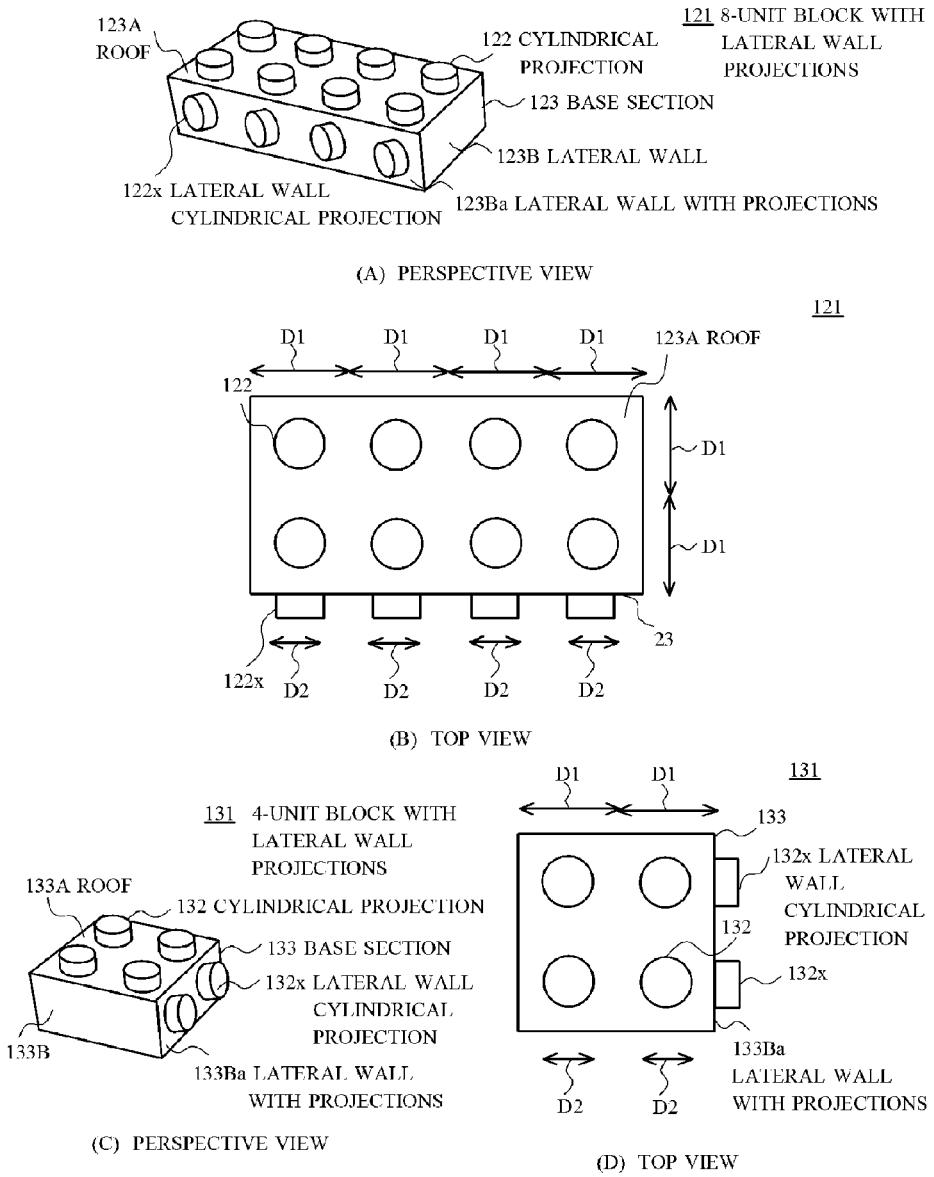
FIG. 12 CONFIGURATION OF BLOCKS WITH LATERAL WALL PROJECTIONS ACCORDING TO FIRST EMBODIMENT

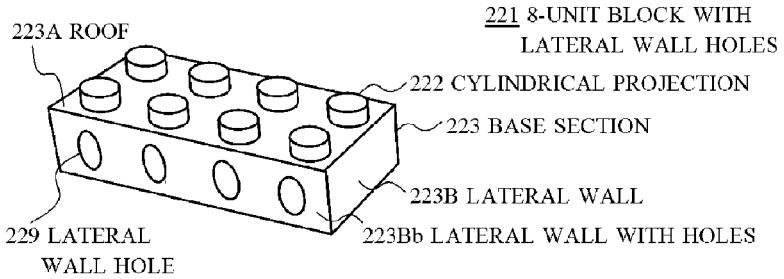
(A) PERSPECTIVE VIEW OF 8-UNIT BLOCK WITH LATERAL WALL HOLES
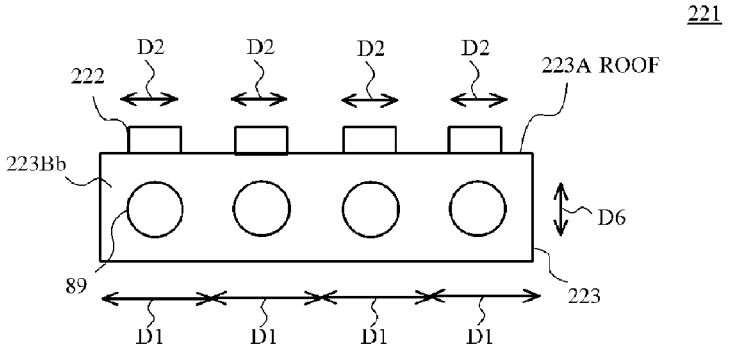
(B) SIDE VIEW
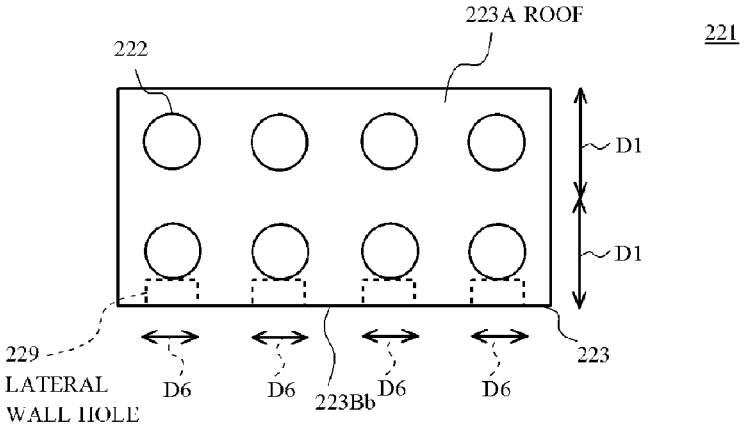
(C) TOP VIEW ILLUSTRATING LATERAL WALL HOLES
FIG. 13 CONFIGURATION OF 8-UNIT BLOCK WITH LATERAL WALL HOLES ACCORDING TO FIRST EMBODIMENT

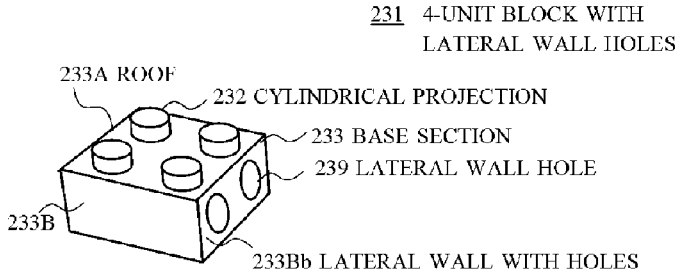
(A) PERSPECTIVE VIEW OF 4-UNIT BLOCK WITH LATERAL WALL HOLES
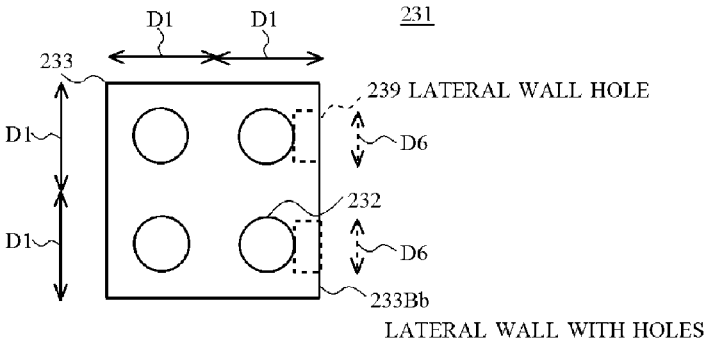
(B) TOP VIEW
FIG. 14 CONFIGURATION OF 4-UNIT BLOCK WITH LATERAL WALL HOLES ACCORDING TO FIRST EMBODIMENT

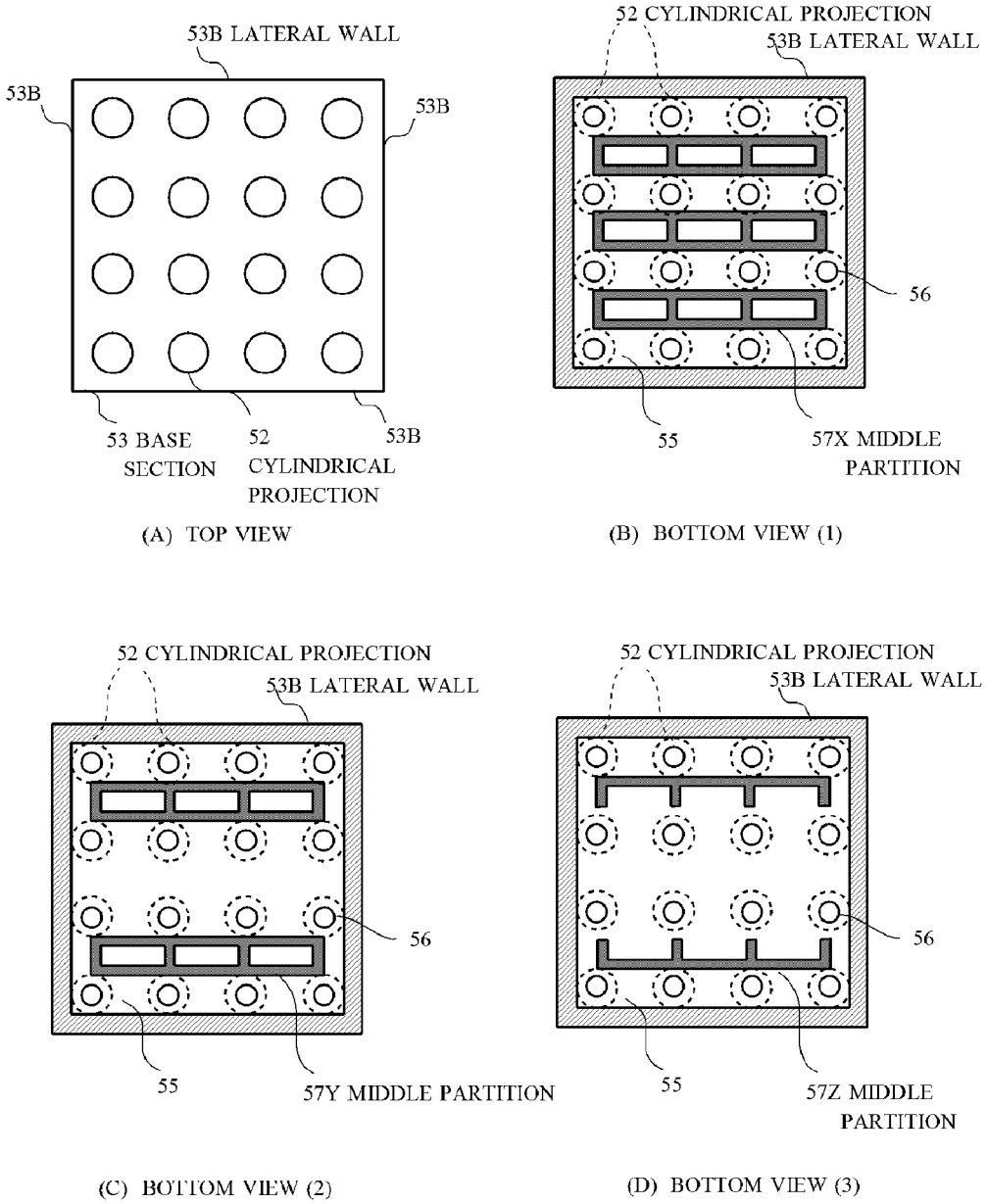
FIG. 15 CONFIGURATION OF 16-UNIT BLOCK ACCORDING TO FIRST EMBODIMENT

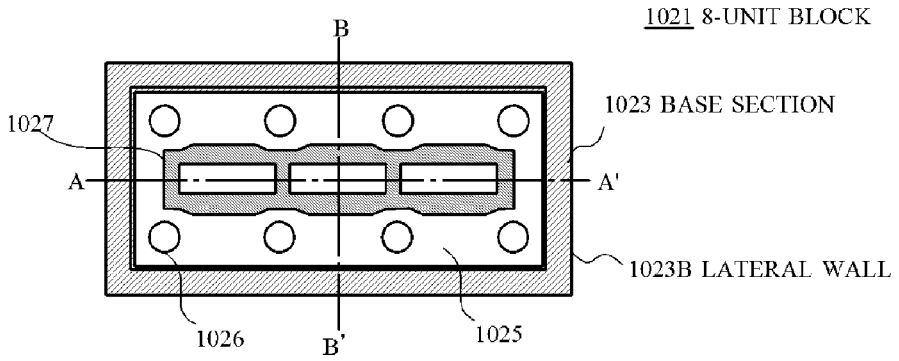
(A) BOTTOM VIEW
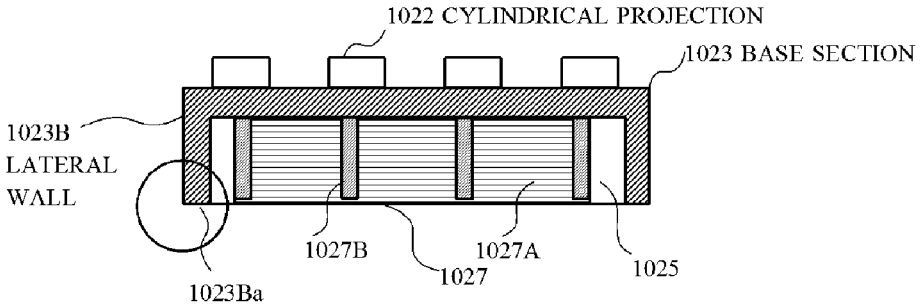
(B) A-A' CROSS-SECTION VIEW
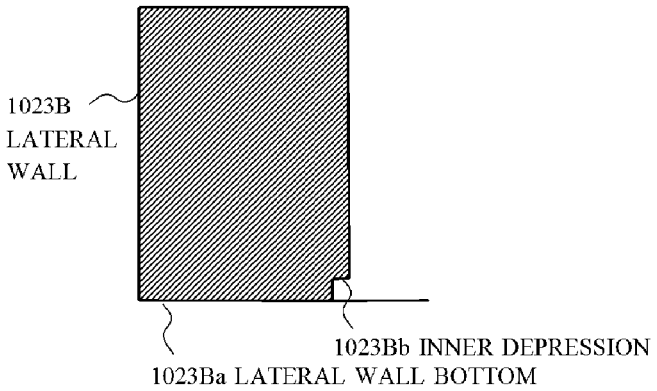
(C) ENLARGED CROSS-SECTION VIEW OF LATERAL WALL BOTTOM
FIG. 16 CONFIGURATION OF 8-UNIT BLOCK ACCORDING TO SECOND EMBODIMENT

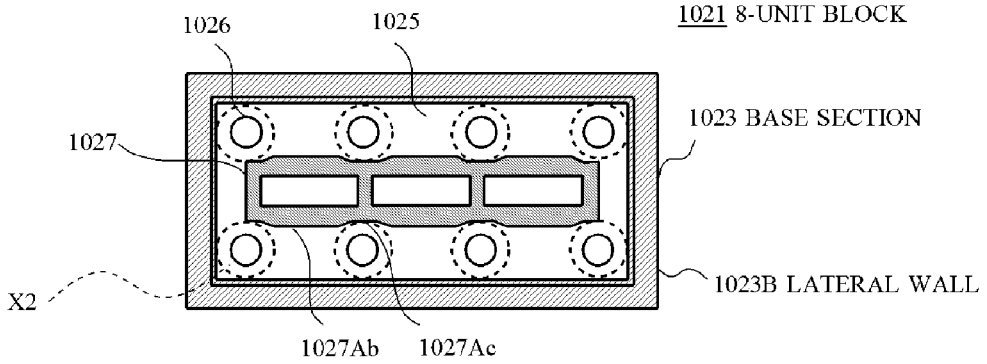
(A) DIAGRAM ILLUSTRATING HOW INTERLOCKING OCCURS
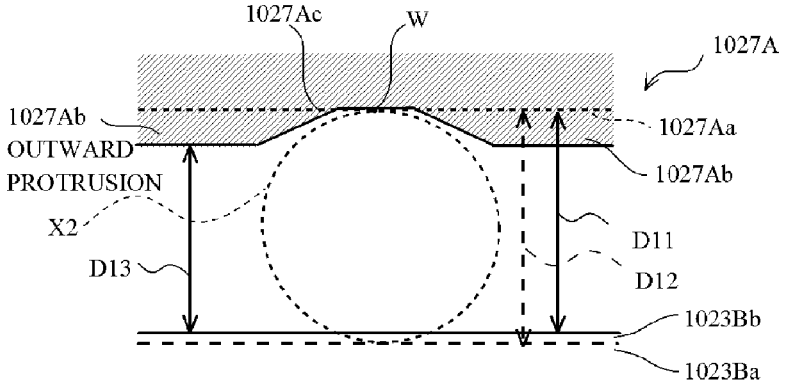
(B) ENLARGED VIEW (1) ILLUSTRATING HOW INTERLOCKING OCCURS
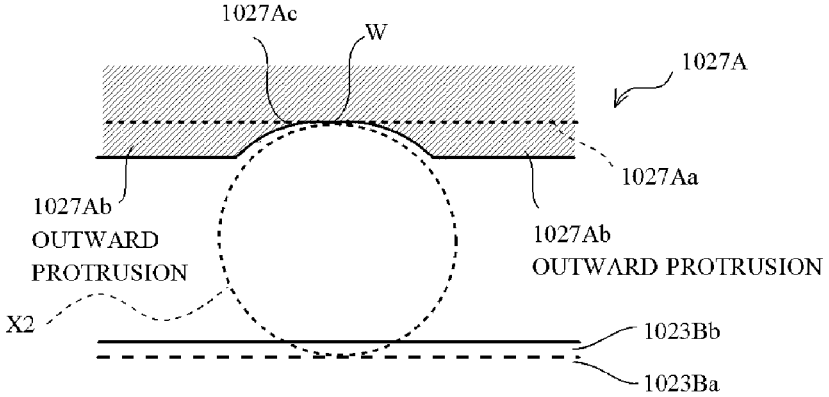
(C) ENLARGED VIEW (2) ILLUSTRATING HOW INTERLOCKING OCCURS
FIG. 17 CONFIGURATION (2) OF 8-UNIT BLOCK ACCORDING TO SECOND EMBODIMENT

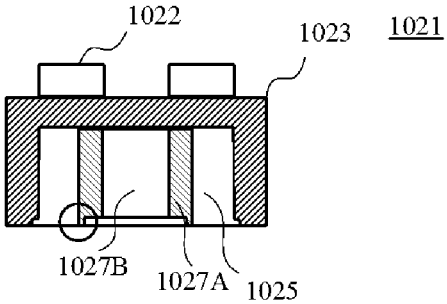
(A) B-B' CROSS-SECTION VIEW
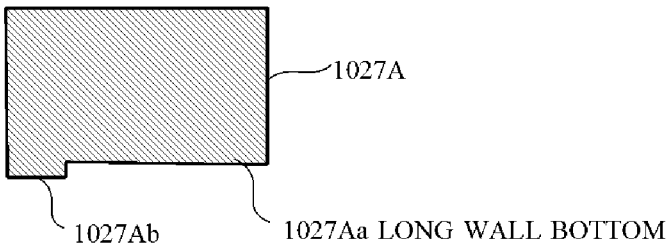
(B) ENLARGED CROSS-SECTION VIEW
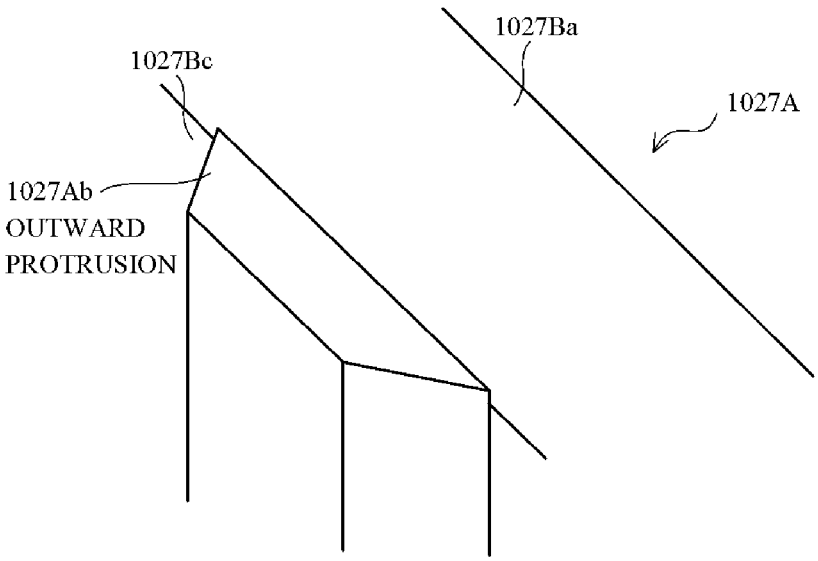
(C) ENLARGED CROSS-SECTION VIEW OF LONG WALL BOTTOM
FIG. 18 CONFIGURATION OF LONG WALL ACCORDING TO SECOND EMBODIMENT

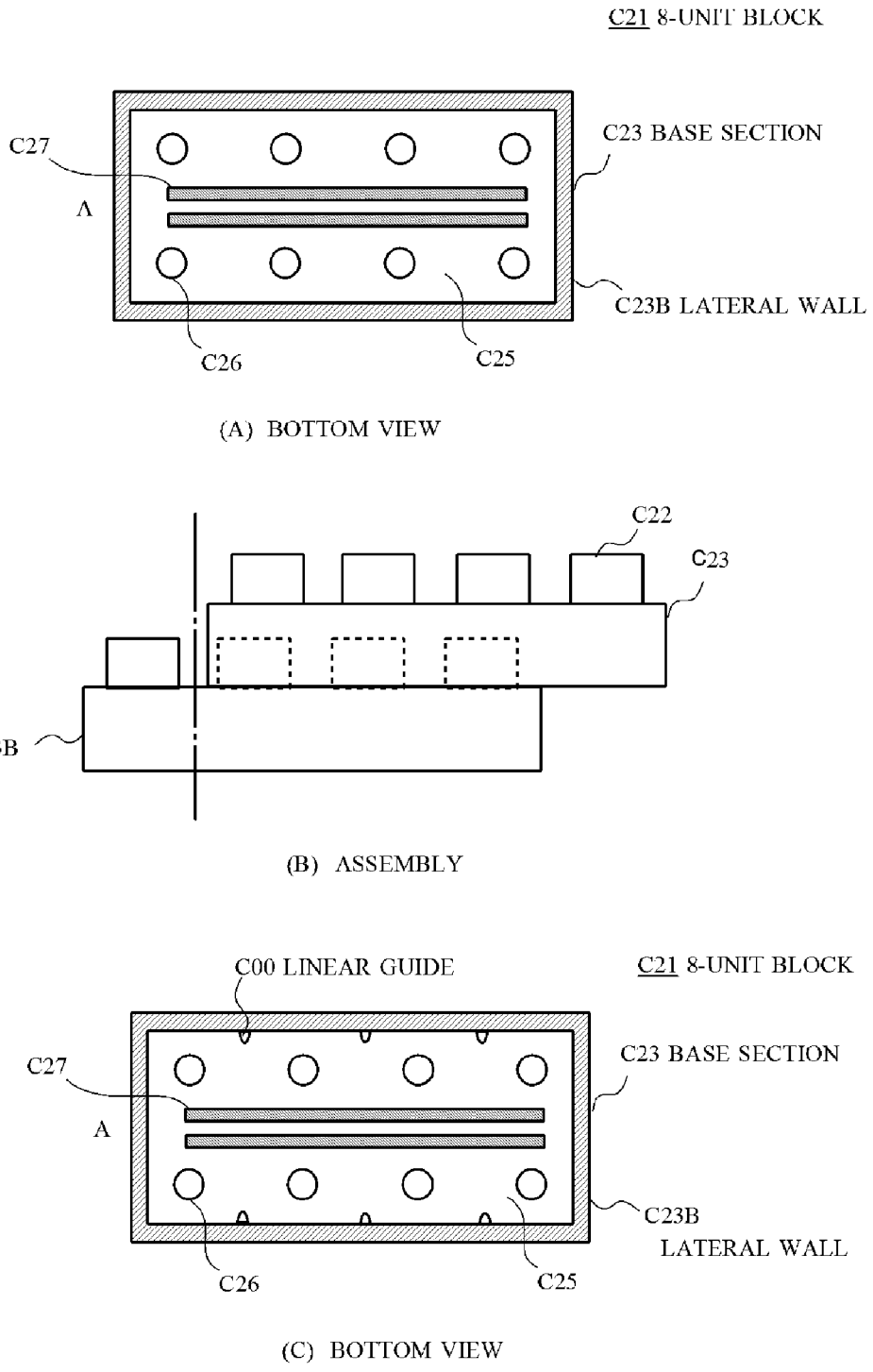
FIG. 19 CONFIGURATION OF CONVENTIONAL 8-UNIT BLOCK

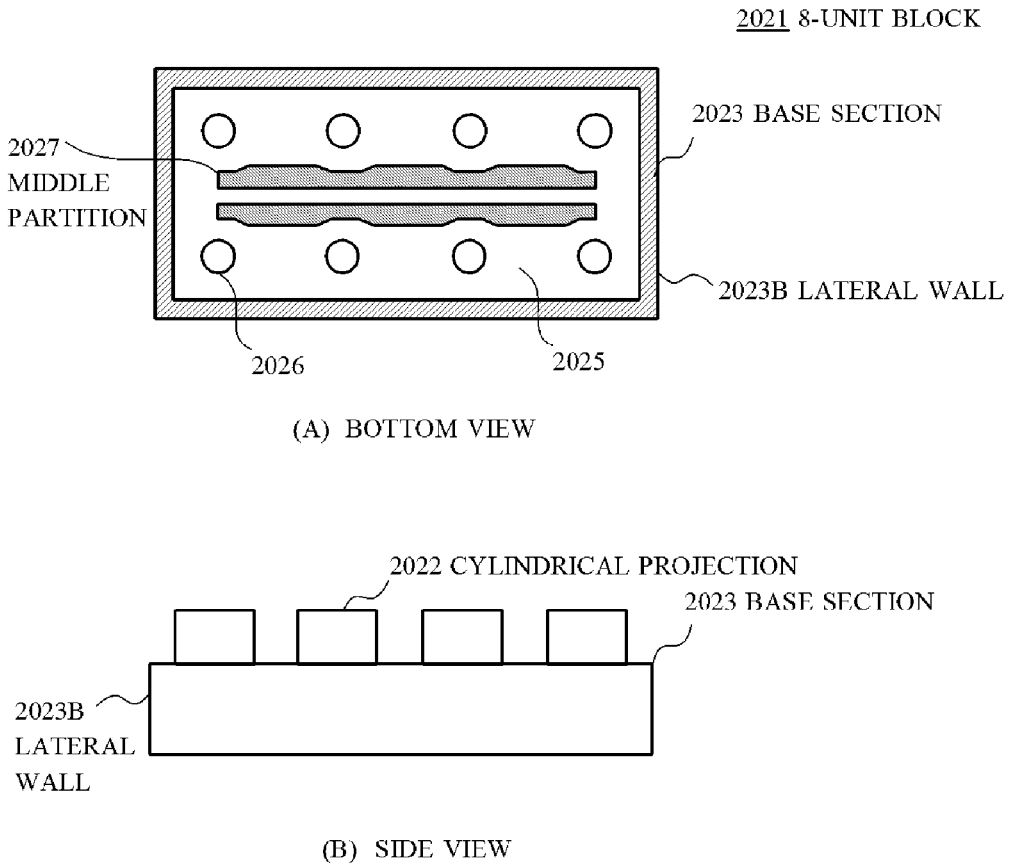
FIG. 20 CONFIGURATION OF 8-UNIT BLOCK ACCORDING TO THIRD EMBODIMENT
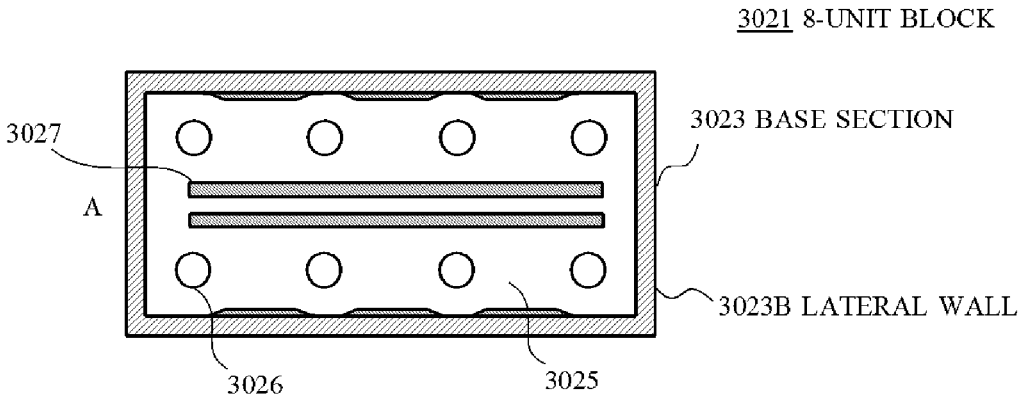
FIG. 21 CONFIGURATION OF 8-UNIT BLOCK ACCORDING TO ANOTHER EMBODIMENT

TOY BLOCK

BACKGROUND OF THE INVENTION

Field of the Invention

The present invention is ideally applied to a toy block enabling the creation of various shapes by assembling multiple blocks.

Description of the Related Art

As illustrated in FIG. 1, a toy block, which consists of a base section C3 having a parallelepiped shape with a hollow bottom and a cylindrical projection C2 projecting in a cylindrical shape from the base section C3, and in which assembly is enabled by interlocking the cylindrical projection C2 into the hollow portion of the base section C3, is conventionally known (see PTL 1, for example).

With this toy block, the creation of various shapes is enabled by suitably combining blocks with different numbers of cylindrical projections, and building up blocks from the bottom upwards.

PATENT LITERATURE

Japanese Unexamined Patent Application Publication (Translation of PCT Application) No. H10-506309

SUMMARY OF THE INVENTION

With blocks of such a configuration (FIGS. 1(A) and 1(B)), there are limits on the shapes that can be formed, since blocks can only be extended in the vertical direction. Also, in the case of wanting to form a complex shape, there has been a problem in that the order of assembly and combinations of blocks must be carefully considered, and there is little freedom of assembly.

Being devised in consideration of the above points, the present invention provides a toy block that may improve the freedom of assembly.

Solution to Problem

In order to solve such problems, a toy block of the present invention is configured to include: a base section configured such that, taking the unit edge length to be 1 and a cube expressed as 1×1×1 to be one unit size, the base section has a parallelepiped shape of size approximately equal to one or more conjoined unit sizes, and is composed of an open, hollow face taken to be the bottom, four lateral walls, and a roof; and cylindrical projections of cylindrical shape provided on the outer face of one or more of the roof and the lateral walls, with a diameter being equal to or greater than 0.4 but less than 0.6 with respect to the unit edge length, and a height being (1−diameter)×(0.4 to 0.5 inclusive); wherein the base section has an interlocking section that is enclosed by the four lateral walls, and by contacting and interlocking with other cylindrical projections of identical shape to the cylindrical projections with respect to at least one of the lateral walls, holds the other cylindrical projections; and the wall thickness near the bottom of the lateral walls is expressed as approximately (1−diameter)×0.5+alpha, where alpha is between −0.05 and 0.03 inclusive.

Thus, in the toy block, even in the case where cylindrical projections project in the horizontal direction, cylindrical projections projecting in the vertical direction and the horizontal direction do not collide with each other, and additionally, cylindrical projections projecting in the horizontal direction are able to firmly hold other blocks.

Advantageous Effects of Invention

According to the present invention, in the toy block, even in the case where cylindrical projections project in the horizontal direction, cylindrical projections projecting in the vertical direction and the horizontal direction do not collide with each other, and additionally, cylindrical projections projecting in the horizontal direction are able to firmly hold other blocks. In this way, the present invention is able to realize a toy block that may improve the freedom of assembly.

BRIEF DESCRIPTION OF THE DRAWINGS

FIG. 1 is a schematic diagram illustrating a configuration of a conventional 1-unit block. (A) is a side view, (B) is a top view, (C) is an illustration of a 1-unit block with a lateral wall projection, (D) is an illustration of a 1-unit block with a lateral wall, and (E) is an illustration of the assembly of a 1-unit block with a lateral wall.

FIG. 2 is a schematic diagram illustrating a configuration of a 1-unit block according to the first embodiment. (A) is a perspective view, (B) is a top view, (C) is a side view, (D) is a cross-section view, and (E) is a bottom view.

FIG. 3 is a schematic diagram illustrating a configuration of a 1-unit block with a lateral wall projection according to the first embodiment. (A) is a perspective view and (B) is a top view.

FIG. 4 is a schematic diagram accompanying a description of the assembly of 1-unit blocks according to the first embodiment. (A) is an illustration of the assembly of a 1-unit block with a lateral wall projection, (B) is an illustration of the assembly of a 1-unit block with a lateral wall hole, and (C) is an illustration of various assembly.

FIG. 5 is a schematic diagram illustrating a configuration of a 1-unit block with a lateral wall hole according to the first embodiment. (A) is a perspective view and (B) is a top view.

FIG. 6 is a schematic diagram illustrating a configuration of a 2-unit block according to the first embodiment. (A) is a perspective view, (B) is a top view, (C) is a side view (1), (D) is a side view (2), and (E) is a bottom view.

FIG. 7 is a schematic diagram illustrating a configuration (1) of a 2-unit block with a lateral wall projection according to the first embodiment. (A) is a perspective view and (B) is a top view.

FIG. 8 is a schematic diagram illustrating a configuration (2) of the 2-unit block with a lateral wall projection according to the first embodiment. (A) is a perspective view and (B) is a top view.

FIG. 9 is a schematic diagram illustrating a configuration (1) of an 8-unit block according to the first embodiment. (A) is a perspective view, (B) is a top view, (C) is a side view, (D) is a front view, and (E) is a bottom view.

FIG. 10 is a schematic diagram illustrating a configuration (2) of the 8-unit block according to the first embodiment. (A) is a bottom view, (B) is a cross-section view along A-A', (C) is a cross-section view along B-B', and (D) is a diagram illustrating how interlocking occurs.

FIG. 11 is a schematic diagram illustrating a configuration of a 4-unit block according to the first embodiment. (A) is a perspective view, (B) is a top view, (C) is a side view, (D) is a front view, and (E) is a bottom view.

FIG. 12 is a schematic diagram illustrating configurations of blocks with lateral wall projections according to the first embodiment. (A) is a perspective view of an 8-unit block with lateral wall projections, (B) is a top view of the 8-unit block with lateral wall projections, (C) is a perspective view of a 4-unit block with lateral wall projections, and (D) is a top view of the 4-unit block with lateral wall projections.

FIG. 13 is a schematic diagram illustrating a configuration of an 8-unit block with lateral wall holes according to the first embodiment. (A) is a perspective view, (B) is a side view, and (C) is a top view illustrating the lateral wall holes.

FIG. 14 is a schematic diagram illustrating a configuration of a 4-unit block with lateral wall holes according to the first embodiment. (A) is a perspective view and (B) is a top view.

FIG. 15 is a schematic diagram illustrating a configuration of a 16-unit block according to the first embodiment. (A) is a top view, (B) is a bottom view (1), (C) is a bottom view (2), and (D) is a bottom view (3).

FIG. 16 is a schematic diagram illustrating a configuration (1) of an 8-unit block according to the second embodiment. (A) is a bottom view, (B) is a cross-section view along A-A', and (C) is an enlarged cross-section view of the lateral wall bottom.

FIG. 17 is a schematic diagram illustrating a configuration (2) of the 8-unit block according to the second embodiment. (A) is a diagram illustrating how interlocking occurs, (B) is an enlarged view (1) illustrating how interlocking occurs, and (C) is an enlarged view (2) illustrating how interlocking occurs.

FIG. 18 is a schematic diagram illustrating a configuration of a long wall according to the second embodiment. (A) is a cross-section view along B-B', (B) is an enlarged cross-section view, and (C) is an enlarged cross-section view of the long wall bottom.

FIG. 19 is a schematic diagram illustrating a configuration of a conventional 8-unit block. (A) is a bottom view, (B) is a diagram illustrating assembly, and (C) is a bottom view.

FIG. 20 is a schematic diagram illustrating a configuration of an 8-unit block according to the third embodiment. (A) is a bottom view and (B) is a side view.

FIG. 21 is a schematic diagram illustrating a configuration of an 8-unit block according to another embodiment.

DETAILED DESCRIPTION OF THE PREFERRED EMBODIMENT

First Embodiment

As illustrated in FIG. 1(C), in an ordinary toy block, the base section C3 is formed in a parallelepiped shape. For example, in the case of a toy block of conventional type such as Diablock (registered trademark), the base section C3 of a 1-unit block C1 is formed such that length×width×height=Cd1×Cd1×Cd2=4×4×3 (specifically, 8.0×8.0×6.0 mm), and this size is taken to be one unit size. The cylindrical projection C2 is formed with a diameter Cd3 of 5.0 mm and a height Cd4 of 3.5 mm.

As illustrated in FIG. 1(C), the case of installing a lateral wall cylindrical projection C2*x* on the lateral wall C3B of this 1-unit block C1 of conventional type will be described. As illustrated in FIGS. 1(D) and (E), since the height differs in the horizontal direction and the vertical direction (length and height) of the parallelepiped, if some other block (hereinafter called "another block") is assembled with respect to the lateral wall cylindrical projection C2*x*, a step is formed between the base sections C3. If another block is assembled, a ubiquitous gap is formed between 1-unit blocks C1 due to the lateral wall cylindrical projection C2*x* contacting the lateral wall C3B of the base section C3.

Even in the hypothetical case where the shape of the base section is simply taken to be length×width×height=Cd1×Cd1×Cd2=1×1×1, the lateral wall cylindrical projection C2*x* butting into the lateral wall 3B of the base section C3 cannot be prevented, and a gap is formed.

In addition, the projecting portion of the lateral wall cylindrical projection C2*x* interlocks inside the lateral walls C3B of the base section C3 of another block. In other words, since the lateral walls C3B of the other block's base section C3 hang off the lateral wall cylindrical projection C2*x*, simply decreasing size of the lateral wall cylindrical projection C2*x* leads to the lateral wall cylindrical projection C2*x* becoming unable to support another block.

The Applicant has discovered that by appropriately setting the relationship between the diameter and height of a cylindrical projection versus the wall width of the base section, another block can be made to firmly interlock with a lateral wall cylindrical projection, even in the case where a lateral wall cylindrical projection is provided on the lateral wall of the block. Hereinafter, an example will be described.

A toy block of the first through third embodiments comprises combining blocks of various units, such as 1-unit blocks, 2-unit blocks, 4-unit blocks, 8-unit blocks, 16-unit blocks, 32-unit blocks, and 64-unit blocks, and the present invention is applied to each unit block. Note that the units of a block may be a natural number, the value of which is not restricted. Note that the size tolerance is plus or minus 1.0%.

Besides such unit blocks, toy blocks may also include unusual blocks with unusual shapes. Note that hereinafter, the respective blocks of unit blocks and unusual blocks will be collectively called toy blocks. Preferably, highly elastic plastic such as ABS (Acrylonitrile-Butadiene-Styrene copolymer) plastic or acrylic plastic is used for all toy blocks.

FIG. 2 illustrates an overall configuration of a 1-unit block in the present embodiment. As illustrated in FIG. 2(A), the 1-unit block has a base section 3 with a parallelepiped shape overall, and a cylindrical projection 2 with a cylindrical shape that projects from the roof 3A of the base section 3.

As illustrated in FIGS. 2(B) and 2(C), the base section 3 is a cube with length×width×height=1×1×1. The unit edge length D1 of the base section 3 is 6.0 mm, or in other words, the unit size is 6.0×6.0×6.0 mm. The cylindrical projection 2 has a diameter D2 that is ½ the unit edge length D1, or 3.0 mm, and a projection height D4 that is ½ the diameter D2, or 1.5 mm. The cylindrical projection 2 is chamfered along the edge of the circle on the upper face. Thus, safety is increased as a toy without sharp angles, while in addition, differences in dimension due to tolerances can be absorbed in the case where cylindrical projections 2 are built on in the vertical and horizontal directions.

As illustrated in FIGS. 2(D) and 2(E), the 1-unit block 1 has a hollow bottom. In other words, the 1-unit block 1 consists of one roof 3A and four lateral walls 3B, with the cylindrical projection 2 projecting from the roof 3A. The cylindrical projection 2 is provided at the center of the roof 3A, and the distance D3 from a lateral wall 3B to the edge of the cylindrical projection 2 is 1.5 mm in all cases. Note that the projection hole section 6 is not necessary.

As illustrated in FIG. 2(D), inside the base section 3, the space of an interlocking section 5 formed by the four lateral walls 3B and a projection hole section 6 are joined. The lateral walls 3B have an approximately uniform thickness overall, and that thickness T1 is ¼ the unit edge length D1, or 1.5 mm.

The horizontal inter-wall distance D5 of the interlocking section 5 (FIG. 2(E)) is ½ the unit edge length D1 in every horizontal direction, or in other words identical to the diameter D2 of the cylindrical projection 2. Consequently, when a cylindrical projection 2 is inserted into the interlocking section 5, that cylindrical projection 2 makes a 4-point contact on the inner faces of the lateral walls 3B constituting the interlocking section 5, and it becomes possible for the base section 3 to hold the cylindrical projection 2. Note that the size of the interlocking section 5 in the horizontal direction is 3.0 mm×3.0 mm.

FIG. 3 illustrates a 1-unit block with a lateral wall projection 101. The 1-unit block with a lateral wall projection 101 has a lateral wall cylindrical projection 102*x*, of identical shape and identical size as the cylindrical projection 102, on a lateral wall with a projection 103Ba, which is one of the lateral walls among the four lateral walls 103B.

Consequently, the 1-unit block with a lateral wall projection 101 is able to interlock not only the cylindrical projection 102 on the roof 103A of another block but also its lateral wall cylindrical projection 102*x* with the interlocking section 5 of another block, making it possible to hold a total of two other blocks. In other words, with the 1-unit block with a lateral wall projection 101, it becomes possible for the direction of blocks which could only be built upwards in the past to be assembled in two directions, as illustrated in FIG. 4(A).

FIG. 5 illustrates a 1-unit block with a lateral wall hole 201. The 1-unit block with a lateral wall hole 201 has a lateral wall hole 209 joined to the space of the interlocking section 205 (not illustrated) on a lateral wall with a hole 203Bb, which is one of the lateral walls among the four lateral walls 203B. The diameter D6 of the lateral wall hole 209 may be appropriately chosen according to material properties or wall thickness, but is nearly identical to the diameter D2, preferably plus or minus 3% of the diameter D2. In this embodiment, the diameter D6 is 3.0 mm and equal to the diameter D2 of the cylindrical projection 102. Also, the depth of the lateral wall hole 209 is equal to the wall thickness T1 of the lateral walls 203B (1.5 mm).

Consequently, the 1-unit block with a lateral wall hole 201 is able to accept the insertion of a cylindrical projection on another block at not only its interlocking section 205 (not illustrated), but also its lateral wall hole 209. In other words, with the 1-unit block with a lateral wall hole 201, assembly becomes possible in which the direction of blocks, which could only be built in one direction in the past, is changed to a difference direction, as illustrated in FIG. 4(B).

As illustrated in FIG. 4(C), by including a 1-unit block with a lateral wall projection 101 and a 1-unit block with a lateral wall hole 201 in a toy block of this embodiment, the direction of cylindrical projections 2 can be increased and the direction of cylindrical projections 2 can be changed, therefore the freedom of assembly of the toy blocks can be significantly improved.

At this point, it is necessary to set the projection height D4 less than or equal to the distance D3 from a lateral wall 3B to the cylindrical projection 2, in order to keep the cylindrical projection 2 of a 1-unit block 1 inserted into the interlocking section 205 of the 1-unit block with a lateral wall hole 201 from contacting the cylindrical projection 2 of a 1-unit block 1 inserted into the lateral wall hole 209.

Since the distance D3 is half the distance which subtract the diameter D2 of the cylindrical projections 2 from the unit edge length D1 {(unit edge length D1−diameter D2)/2}, it is necessary that the projection height D4 be less than or equal to {(unit edge length D1−diameter D2)/2}.

At this point, the 1-unit block with a lateral wall projection 101 will support a 1-unit block engaged in the horizontal direction. The lateral wall cylindrical projection 102 makes linear contact on the inner faces of the lateral walls 3B of another block. For this reason, at first glance it appears that the holding strength of a 1-unit block engaged in the horizontal direction can be raised by increasing the projection height D4 (see FIG. 2(C)) as much as possible.

However, an increase in the projection height D4 requires an equivalent decrease in the diameter D2. If the diameter D2 is overly decreased, the cylindrical projection 2 becomes needle-like, and the danger of puncturing one's hand may occur. Also, if the diameter D2 is decreased, the wall thickness T1 must be increased, requiring large amounts of material.

By having the diameter D2 with respect to the unit edge length D1 be 0.4 or greater, the cylindrical projection 2 does not become needle-like, and safety as a toy can be guaranteed. Also, it is further preferable for the diameter D2 with respect to the unit edge length D1 to be 0.45 or greater, in order to maintain the external appearance as a toy block.

By having the diameter D2 with respect to the unit edge length D1 be less than 0.6, a comparatively large wall thickness T1 can be ensured. For this reason, a cylindrical projection projecting in the horizontal direction can suitably hold another block without the lateral walls 3B deforming, even in cases where additional weight from the lateral walls 3B is applied due to their own weight, etc. In order to reduce the material used while sufficiently ensuring the thickness of the wall thickness T1, it is further preferable to have the thickness of the wall thickness T1 be less than 0.55.

A 1-unit block 1 of this embodiment is designed such that, for a unit edge length D1=1, the diameter D2 of the cylindrical projection 2 is ½, the projection height D4 is ¼, and the wall thickness T1 is ¼. Thus, it is possible to mold a block with excellent proportions in the points of other block holding strength, appearance, safety, and material usage.

As illustrated in FIG. 6, a 2-unit block 11 has an outward shape like that of two 1-unit blocks 1 lined up. The 2-unit block 11 has a base section 13 with a parallelepiped shape and two cylindrical projections 12. The cylindrical projections 12 have an identical shape to the cylindrical projection 2 of the 1-unit block 1.

The base section 13 has the size of two conjoined 1-unit sizes, with edges in the one horizontal direction and the height being equal to the unit edge length D1, while the edges in the other horizontal direction is twice the unit edge length D1. Taking the unit edge length D1 to be 1, the base section 13 has the size of length×width×height=1×2×1. Specifically, the length×width×height=6.0 mm×12.0 mm×6.0 mm, the wall thickness T1=1.5 mm, and the distance D3=1.5 mm.

As illustrated in FIG. 6(E), the 2-unit block 11 has an interlocking section 15 formed by the inner faces of the four lateral walls 13B. Specifically, the size of the interlocking section 15 in the horizontal direction is 3.0 mm×9.0 mm. If the cylindrical projection of another block is inserted into this 2-unit block 11, the cylindrical projection and the lateral walls 13B contact at three points, holding the other block.

As illustrated in FIG. 7, in a 2-unit block with a lateral wall projection 111A, a lateral wall cylindrical projection 112*x* is provided on a lateral wall with a projection 113Ba having the short edge in the horizontal direction from among the four lateral walls 113B. The shape of the lateral wall cylindrical projection 112*x* is identical to the cylindrical projections 12.

As illustrated in FIG. 8, in a 2-unit block with lateral wall projections 111B, two lateral wall cylindrical projections

112*x* are provided on a lateral wall with projections 113Ba having the long edge in the horizontal direction from among the four lateral walls 113B.

In addition, although not illustrated, in 2-unit blocks with lateral wall holes 211A and 211B, respective lateral wall holes 219 are provided on a lateral wall with holes 213Bb having the short edge or long edge in the horizontal direction from among the four lateral walls 213B, similarly to the 2-unit blocks with lateral wall projections 111A and 111B. The shapes of the lateral wall holes 219 are identical to the lateral wall hole 209 of the 1-unit block with a lateral wall hole 201.

As illustrated in FIG. 9, an 8-unit block 21 has an outward shape of eight 1-unit blocks 1 lined up. The 8-unit block 21 has a base section 23 with a parallelepiped shape and eight cylindrical projections 22. The cylindrical projections 22 have an identical shape to the cylindrical projection 2 of the 1-unit block 1.

The base section 23 has the size of eight conjoined 1-unit sizes, with edges in the one horizontal direction being equal to twice the unit edge length D1, while the other edges in the other horizontal direction is four times the unit edge length D1. Taking the unit edge length D1 to be 1, the base section 23 has the size of length×width×height=2×4×1. Specifically, the length×width×height=12.0 mm×24.0 mm×6.0 mm, the wall thickness T1=1.5 mm, and the distance D3=1.5 mm.

As illustrated in FIGS. 9(E) and 10(A), the 8-unit block 21 has an interlocking section 25 formed by the inner faces of the four lateral walls 23B. Specifically, the size of the interlocking section 25 in the horizontal direction is 21.0 mm×9.0 mm. In the interlocking section 25, a middle partition 27 that constitutes the interlocking section 25 together with the lateral walls 23B is formed on the centerline in the longer direction. Insertion of cylindrical projections is made easier by having the middle partition 27 be slightly shorter than the lateral walls 23B in the height direction.

The middle partition 27 is composed of two long walls 27A in the longer direction, and four short walls 27B that are orthogonal to the long walls 27A and join the two long walls 27A. As illustrated in FIG. 10(D), if the cylindrical projections of another block are inserted into this 8-unit block 21, the four cylindrical projections positioned at the ends in the longer direction and the lateral walls 23B contact at three points. Meanwhile, the other block is held such that the four cylindrical projections positioned inwardly in the longer direction and the lateral walls 23B contact at two points.

The short walls 27B are provided at the portions where the cylindrical projections of another block and the long walls 27A contact, and suppress deformation of the long walls 27A due to additional weight from those cylindrical projections. In other words, by having the shape of three conjoined hollow rectangles, the middle partition 27 is made to keep its strength as a middle partition 27 while reducing material usage. Note that the long walls 27A may also be in a state of extending out past the short walls 27B.

As illustrated in FIG. 11, a 4-unit block 31 has an outward shape of four 1-unit blocks 1 lined up. The 4-unit block 31 has a base section 33 with a parallelepiped shape and four cylindrical projections 32. The cylindrical projections 32 have an identical shape to the cylindrical projection 2 of the 1-unit block 1.

In the base section 33, edges in the horizontal direction are equal to twice the unit edge length D1. Taking the unit edge length D1 to be 1, the base section 33 has the size of length×width×height=2×2×1. Specifically, the length×width×height=12.0 mm×12.0 mm×6.0 mm, the wall thickness T1=1.5 mm, and the distance D3=1.5 mm.

As illustrated in FIG. 11(E), the 4-unit block 31 has a middle partition 37 inside the interlocking section 35 formed by the inner faces of the four lateral walls 33B. The length of the middle partition 37 in the height direction is identical to the middle partition 27 in the 8-unit block 21. Although the middle partition 37 has an I-shaped construction, it may also be a hollow rectangle similar to the middle partition 27.

As illustrated in FIG. 12, in an 8-unit block with lateral wall projections 121, four lateral wall cylindrical projections 122*x* are provided on a lateral wall with projections 123Ba having the long edge in the horizontal direction from among the four lateral walls 123B. The shape of the lateral wall cylindrical projections 122*x* is identical to the cylindrical projections 12. Furthermore, although not illustrated, two lateral wall cylindrical projections 122*x* may also be provided on a lateral wall with projections 123Ba having the short edge in the horizontal direction from among the four lateral walls 123B. The 4-unit block with lateral wall projections 131 is also similar, and two lateral wall cylindrical projections 132*x* may be provided on any lateral wall with projections 133Ba.

In addition, as illustrated in FIG. 13, in an 8-unit block with lateral wall holes 221, four lateral wall holes 229 are provided on a lateral wall with holes 223Bb having the long edge in the horizontal direction from among the four lateral walls 223B, similarly to the 8-unit block with lateral wall projections 121. The shape of the lateral wall holes 229 is identical to the lateral wall hole 209 of the 1-unit block 201. Furthermore, although not illustrated, two lateral wall holes 229 may also be provided on a lateral wall with holes 223Bb having the short edge in the horizontal direction from among the four lateral walls 223B.

As illustrated in FIG. 14, in a 4-unit block with lateral wall holes 231, two lateral wall holes 239 are provided on a lateral wall with holes 233Bb, which is one edge in the horizontal direction from among the four lateral walls 233B, similarly to the 4-unit block with lateral wall projections 131. The shape of the lateral wall holes 239 is identical to the lateral wall hole 209 of the 1-unit block 201.

Although lateral wall cylindrical projections may also be formed on two or more lateral walls, they are preferably formed on only one. This is because construction as a toy block cannot become simplistic if lateral wall cylindrical projections are formed on multiple faces.

Lateral wall holes are also similar, and although they may be formed on two or more lateral walls, they are preferably formed on only one. This is because the appearance as a toy block can be kept by not outwardly exposing unused lateral wall holes.

As illustrated in FIG. 15, a 16-unit block 51 has an outward shape of sixteen 1-unit blocks 1 lined up. The 16-unit block 51 has a base section 53 with a parallelepiped shape and sixteen cylindrical projections 52. The cylindrical projections 52 have an identical shape to the cylindrical projection 2 of the 1-unit block 1.

Middle partitions 57X may be provided on every row as part of the interlocking section 55, as illustrated in FIG. 15(B), or middle partitions 57Y may also be partially provided, as illustrated in FIG. 15(C). In addition, middle partitions 57Z may also be configured with just one long wall 57A, as illustrated in FIG. 15(D). These configurations of middle partitions 57 may also be applied to blocks of any units, such as 4-, 8-, and 32-unit blocks.

According to the above configuration, the base section 3 of the 1-unit block 1 of the present invention is configured such that, taking the unit edge length D1 to be 1 and a cube expressed as 1×1×1 to be one unit size, or in other words a 1-unit block 1, the base section 3 has a parallelepiped shape in which one or multiple unit sizes are conjoined, being composed of an open, hollow face taken to be the bottom, four lateral walls 3B, and a roof 3A.

The cylindrical projection 2 has a cylindrical shape and is provided on the outer face of one or more of the roof 3A and lateral walls 3B, with its diameter D2 being equal to or greater than 0.4 but less than 0.6 with respect to the unit edge length D1, and its height being (1−diameter)×(0.4 to 0.5 inclusive).

The interlocking section 5 is enclosed by the four lateral walls 3B, and by contacting and interlocking with another cylindrical projection X2 of identical shape to the cylindrical projection 2 with respect to at least one of the lateral walls 3B, holds that cylindrical projection X2. Additionally, of the interlocking section, the wall thickness T1 near the bottom of a lateral wall 3B contacting and holding the other cylindrical projection X2 is expressed as (1−diameter)×0.5+alpha, where alpha is between −0.05 and 0.03 inclusive, and more preferably, alpha is between −0.02 and 0.01 inclusive. Stated differently, the wall thickness T1 is approximately (1−diameter)×0.5. Note that an alpha may occur in the case of uniformly reducing the dimensions of the base section in each unit block from their unit sizes, or in the case of designing the inter-wall distance D5 to be less than the diameter D2, for example, and in the present embodiment, the alpha is zero.

Thus, when the interlocking section 5 of the 1-unit block 1 interlocks with another cylindrical projection X2 projecting out in the horizontal direction, the other cylindrical projection X2 can be firmly held by the holding force due to the balance between the diameter D2 and height D4 of the other cylindrical projection X2 as well as the thickness of the wall thickness T1, even though the size of the other cylindrical projection X2 is small due to constraints for projecting cylindrical projections 2 vertically and horizontally.

The cylindrical projection 2 has a diameter that is equal to or greater than 0.45 but less than 0.55, and a height that is (1−diameter)×(0.45 to 0.5 inclusive). Thus, the 1-unit block 1 is able to hold another cylindrical projection X2 much more reliably due to this balance.

The parallelepiped shape of the base section 23 consists of a shape of conjoined unit sizes of at least 2×2 or greater, while the interlocking section 25 has a middle partition 27 that contacts other cylindrical projections X2 in the interlocking section enclosed by the four lateral walls 23B. Thus, other cylindrical projections X2 can be reliably held, even in a unit block having two or more rows of cylindrical projections 22 in the shorter direction, such as the 8-unit block 21, for example.

In the 1-unit block with a lateral wall projection 101, a lateral wall cylindrical projection 102*x* of nearly identical size as the cylindrical projection 102 is provided on at least one of the four lateral walls 103B. Thus, with the 1-unit block with a lateral wall projection 101, other blocks can be assembled not just vertically but also horizontally, potentially improving the freedom of assembly.

In the 1-unit block with a lateral wall hole 201, a lateral wall hole 209 of nearly identical size as the cylindrical projection 202 is provided on at least one of the four lateral walls 203B. Thus, with the 1-unit block with a lateral wall hole 201, the direction in which cylindrical projections 202 project can be deflected 90 degrees, potentially improving the freedom of assembly. Note in this embodiment, diameter D2 is slightly smaller than inter-wall distance D5 preferably, since the interlocking section 5 can hold the cylindrical projection 2 more reliably.

Second Embodiment

FIGS. 16 to 18 illustrate a second embodiment which differs from the first embodiment illustrated in FIGS. 2 to 15 in that a step is provided on the inner faces of the lateral walls 1023B, and in the configuration of the middle partition 1027. Note that in the second embodiment, signs with 1000 added are attached to portions that correspond to the first embodiment.

As illustrated in FIGS. 16(A) to 16(C), the lateral walls 1023B are formed such that the angle between the inner face of a lateral wall 1023B and a lateral wall bottom 1023Ba at the bottom is cut out on the inner side of the lateral wall bottom 1023Ba, and the cross section has a rectangular inner depression 1023Bb. This inner depression 1023Bb is provided along the inner side of the four lateral walls 1023B enclosing the interlocking section 1025, with one edge being 0.1 to 0.3 mm. Note that the shape of the inner depression 1023Bb is not restricted, and the cross section may also have a triangular or circular cutout.

As illustrated in FIG. 17(A), the long walls 1027A of the middle partition 1027 have outwardly bulging outward protrusions 1027Ab at each region that does not interlock with the cylindrical projection X2 of another block, which thereby form depressed interlocking depressions 1027Ac only in regions where a cylindrical projection X2 interlocks.

As illustrated in FIG. 17(B), a boundary line 1027Aa is taken to be the extension extending parallel to a long wall 1027A from the region of the long wall 1027A that is farthest away from the lateral walls 1023B (in other words, the maximally depressed part of an interlocking depression 1027Ac). The inter-wall distance D11 from the boundary line 1027Aa to the inner face of a lateral wall 1023B is formed slightly smaller (2.7 mm~2.9 mm, for example) than the diameter D2 (3.0 mm) of a cylindrical projection 1022. The outward protrusions 1027Ab project approximately 0.5 mm to 2.0 mm from the boundary line 1027Aa at their maximally protruding part.

In addition, the opening distance D12 from the intersection point of the lateral wall bottom 1023Ba in the inner depression 1023Bb (FIG. 16(C)) to the boundary line 1027Aa (FIG. 17(B)) is formed equal to the diameter D2 or slightly larger (3.0 to 3.1 mm, for example) than the diameter D2.

As illustrated in FIG. 18, the outward protrusions 1027Ab are formed to project slightly from the region farther inward than the boundary line 1027Aa of a long wall 1027A (0.1 to 0.3 mm, for example), with their tips being formed at positions identical to or slightly inward (inward by 0.0 mm to 0.1 mm, for example) from the lateral wall bottom 1023Ba.

For this reason, if a user attempts to insert the cylindrical projection X2 of another block into the interlocking section 1025, the cylindrical projection X2 of the other block will be naturally inserted between the maximally projecting lateral walls 1023B and the outward protrusions 1027Ab in the bottom of the 8-unit block 1021.

At this point, in the long walls 1027A of the middle partition 1027, the distance D13 from the outward protrusions 1027Ab to the lateral wall bottom 1023Ba (FIG. 17(B)) is formed smaller than the diameter D2 of a cylindrical projection X2. For this reason, cylindrical projections X2 naturally fit inside the interlocking depressions 1027Ac, and are guided to suitable positions inside the interlocking section 1025.

Although cylindrical projections X2 temporarily catch inside the inner depression 1023Bb, since the step is small, they are easily inserted deeper past the inner depression 1023Bb by the user's pushing action. Since the inter-wall distance D11 is smaller than the diameter D2 of a cylindrical projection X2, the lateral walls 1023B continuously push against the cylindrical projections X2, firmly holding them.

At this point, since the wall thickness T1 is designed to be sufficiently thick, there is little risk of plastic deformation of the lateral walls 1023B. Additionally, there is little risk of plastic deformation due to the short walls 1027B provided at the portions that contact a cylindrical projection X2 in the middle partition 1027.

The interlocking depressions 1027Ac are trapezoidal depressions, and the legs of the trapezoid have a gentler slope than the curvature of a cylindrical projection X2. For this reason, an interlocking depression 1027Ac is able to contact a cylindrical projection X2 only at its maximally depressed point (line) and hold that cylindrical projection X2.

In other words, taking a contact point W to be the point positioned at the highest point on the page of the cylindrical projection X2 on the page in FIG. 17(B), when the cylindrical projection X2 moves left or right, the interlocking depression 1027Ac is configured such that the interlocking depression 1027Ac begins to slope and the distance between the interlocking depression 1027Ac and the lateral wall 1023B shortens before contact is made inside the interlocking depression 1027Ac at sites other than the contact point W. For this reason, the cylindrical projection X2 is substantially unable to move left or right, and its contact point with the interlocking depression 1027Ac becomes just one point.

Note that the interlocking depressions 1027Ac may also be such that the angled portions of the trapezoid are curved as in FIG. 17(C), or circular. It is sufficient for the sloped portions to be gentler than the curve of a cylindrical projection X2.

According to the above configuration, in an 8-unit block 1021, it is configured such that the outward protrusions 1027Ab are included on at least one face of the long walls 1027A. The outward protrusions 1027Ab acts as a guide mechanism and the position where other cylindrical projections X2 contact on the boundary line 1027Aa is maximally depressed.

Thus, the 8-unit block 1021 is able to moderately maintain holding force on another interlocked unit block without increasing the contact point between the other cylindrical projections X2 and the long walls 1027A and without the other cylindrical projections X2 becoming misaligned in the horizontal direction. It is also possible to prevent the holding force from becoming excessive due to the increased number of cylindrical projections 1022.

The inter-wall distance D11 from a lateral wall 1023B to a long wall 1027A where one other cylindrical projection should be interlocked is formed slightly smaller than the diameter D2 of a cylindrical projection 1022. Thus, the smallness of the contact area with the interlocking section 5 due to the height smallness of the cylindrical projection 1022 is canceled, and another block can be firmly held. Although not illustrated, in this embodiment, the inter-wall distance D5 between two lateral walls is formed slightly smaller than the diameter D2 of a cylindrical projection 1022 in the case of a unit block with one row on its shorter edge.

Third Embodiment

FIGS. 20 and 21 illustrate a third embodiment which differs from the second embodiment illustrated in FIGS. 16 to 18 in the wall thickness T1 and the size of the cylindrical projection 2022 and in that the middle partition 2027 lacks short walls. Note that in the third embodiment, signs with 1000 added are attached to portions that correspond to the second embodiment.

As illustrated in FIG. 19(A), with respective unit blocks in a conventional toy block, no kind of barrier is provided, so that the cylindrical projections CX22 of other blocks move parallel to the middle partition C27. For this reason, as illustrated in FIG. 19(B), there has been a problem in that the cylindrical projections C22 and the cylindrical projections CX22 of another block become misaligned in the case of assembling with the cylindrical projections C22 in a shifted state.

Also, as illustrated in FIG. 19(C), it is known to provide linear guides, being linear protrusions, on the inner sides of the lateral walls C23B. However, since cylindrical projections CX22 stop moving by contacting the linear guides COO, the number of contact points for the cylindrical projections CX22 increases, and great force is required during removal. Or, when linear guides COO are small not to contact CX22, the liner guide COO cannot stop CX22 moving enough.

As illustrated in FIG. 20(A), in an 8-unit block 2021 of this embodiment, the middle partition 2027 of the second embodiment is applied to the 8-unit block 2021 of identical configuration as a conventional unit block C21. Specifically, the 8-unit block 2021 is formed such that length×width×height=Cd1×Cd1×Cd2=4×4×3 (specifically, 8.0×8.0×6.0 mm). The cylindrical projection C2 is formed with a diameter Cd3 of 5.0 mm and a height Cd4 of 3.5 mm, while the wall thickness of the lateral walls 2023B is 1.5 mm.

The middle partition 2027 is configured with two long walls 2027A only, and lacks short walls. By using plastic with comparatively high flexibility, such as polypropylene plastic or styrene plastic, for example, plastic deformation can be prevented even without short walls.

In this way, it is possible to prevent the cylindrical projections 20X2 of another block from moving parallel to the middle partition 2027, even in the case of applying the middle partition 2027 of the second embodiment to a conventional unit block. Applying the middle partition 2027 is particularly effective for unit blocks having cylindrical projections 2022 with a diameter D2 equal to or greater than 0.4 but less than 0.8, in which horizontal misalignment readily occurs.

According to the above configuration, in an 8-unit block 2021 having cylindrical projections 2022 with a diameter D2 equal to or greater than 0.4 but less than 0.8, the wall thickness T1 near the bottom of the lateral walls 2023B is expressed as approximately (1−diameter)×0.5+alpha, where alpha is between −0.05 and 0.03 inclusive. Additionally, the 8-unit block 2021 is provided with outward protrusions 2023Bb as a guide mechanism on at least one face of the lateral walls 2023B and the long walls 2027A constituting the interlocking section 2025.

Thus, the 8-unit block 2021 is able to moderately maintain holding force on another interlocked unit block without the other cylindrical projections 20X2 becoming misaligned in the horizontal direction. It is also possible to prevent the holding force from becoming excessive due to the increased number of cylindrical projections 2022.

Other Embodiments

Note that according to the second embodiment discussed above, the case of providing outward protrusions 1027Ab on the 8-unit block 1021 was described. The present invention is not limited thereto, and the outward protrusions 1027Ab may be applied to all blocks with two or more rows of cylindrical projections, such as 4, 6, 10, 12, 16, and so on. Similarly for the third embodiment, the outward protrusions 2027Ab may be applied to unit blocks consisting of various numbers.

Also, according to the second embodiment discussed above, the case of providing inner depressions 1023Bb on the 8-unit block 1021 was described. The present invention is not limited thereto, and similar advantages can be obtained by applying the above to respective unit blocks in the first and third embodiments. Also, as illustrated in FIG. 21, similar advantages can be obtained even by providing the outward protrusions 1027Ab on the inner sides of the lateral walls 1023B.

Furthermore, according to the first through third embodiments discussed above, the case of having one unit size be equal to the size of a 1-unit block was described. The present invention is not limited thereto, and is unrestricted insofar as it is within the size range of the present invention. For example, rather than sizes which are a natural number multiple of the 1-unit size, it is also possible to form blocks which are smaller by a given size (0.1 mm, for example) in just the horizontal direction. In other words, a 1-unit block becomes 5.9×5.9×6.0 mm in size, a 2-unit block becomes 5.9×11.9×6.0 mm in size, and a 4-unit block becomes 11.9×11.9×6.0 mm in size. In this case, adjustment is conducted with the wall thickness T1 rather than the inter-wall distance D5, and is reflected in the value of alpha. Thus, it is possible to absorb size differences due to tolerances in the horizontal direction. In this example, the adjustment becomes alpha=(−0.1/6)/2+inter-wall distance D5 for a 1-unit block.

Furthermore, in the third embodiment discussed above, the case of having the 1-unit size be 8.0×8.0×6.0 mm was described. The present invention it not limited thereto, and the present invention is applicable to unit blocks of various other sizes.

INDUSTRIAL APPLICABILITY

The present invention can be utilized for various toy blocks which can be assembled.

REFERENCE SIGNS LIST

1: 1-unit block
2, 12, 22, 32, 52, 102, 202, 1022: cylindrical projection
3, 13, 23, 33, 53, 103, 203, 1023: base section
3B, 13B, 23B, 33B, 53B, 103B, 203B, 1023B: lateral wall
3A, 13A, 23A, 33A, 53A, 103A, 203A, 1023A: roof
T1: wall thickness
D1: unit edge length
D2: diameter
D5: inter-wall distance

What is claimed is:

1. A toy block comprising: a base section configured such that, taking a unit edge length to be 1 and a cube expressed as 1×1×1 to be one unit size, comprises a parallelepiped shape of size approximately equal to one or more conjoined unit sizes, four lateral walls, a roof and a bottom comprising a hollow face; and a cylindrical projection of a cylindrical shape provided on at least one of the roof and the lateral walls, with a diameter being equal to or greater than 0.45 but less than 0.55 with respect to the unit edge length, and a height being (1−diameter)×(0.45 to 0.5 inclusive);

wherein the base section comprises an interlocking section enclosed by the four lateral walls, the interlocking section configured to contact and interlock with at least one cylindrical projection of another toy block with an identical shape to the cylindrical shape; and a wall thickness near the bottom expressed as (1−diameter)×0.5+alpha, where alpha is between −0.05 and 0.03 inclusive, and wherein the parallelepiped shape comprises a size of at least 2×2 or more conjoined unit sizes, and the interlocking section comprises a middle partition not connected to the lateral walls comprising an outside face comprising a long wall comprising a depression configured to contact with the at least one cylindrical projection of another toy block at the depression and at least one of the lateral walls facing the middle partition; and wherein the depression comprises a trapezoidal shape with legs having a gentler slope than a curvature of the cylindrical shape so that the depression is configured to contact the at least one cylindrical projection at a line of maximal depression.

2. The toy block according to claim 1, wherein at least one of the four lateral walls comprises a lateral wall cylindrical projection orthogonal to the cylindrical projection.

3. The toy block according to claim 1, wherein at least one of the four lateral walls comprises a lateral wall hole of approximately equal size to the cylindrical projection.

4. The toy block according to claim 1, wherein an inter-wall distance between one of the four lateral walls to the long wall where the at least one cylindrical projection is configured to be interlocked is slightly smaller than the diameter of the cylindrical projection.

5. The toy block according to claim 1, wherein at least one face of the long wall comprises a guide mechanism configured to guide the at least one cylindrical projection of another toy block.

6. The toy block according to claim 1, wherein each of the lateral walls comprises an inner depression configured to enclose the interlocking section.

7. The toy block according to claim 1, wherein the toy block comprises the cylindrical projection and a lateral wall cylindrical projection that are perpendicular to each other.

8. A toy block comprising:

a base section configured such that, taking a unit edge length to be 1 and a parallelepiped expressed as 1×1×X to be one unit size, comprises a parallelepiped shape in which one or more unit sizes are conjoined, four lateral walls, a roof and a bottom comprising a hollow face; and a cylindrical projection of cylindrical shape provided on an outer face of at least one of the roof and the lateral walls with a diameter being equal to or greater than 0.4 but less than 0.8 with respect to the unit edge length;

wherein the base section further comprises;

an interlocking section enclosed by the four lateral walls, a wall thickness near the bottom expressed as (1−diameter)×0.5+alpha, where alpha is between −0.05 and 0.03 inclusive, and wherein the parallelepiped shape comprises a size of at least 2×2 or more conjoined unit sizes, and the interlocking section comprises a middle partition not connected to the four lateral walls comprising a long wall and a guide mechanism comprising slopes configured to guide at least one cylindrical projection of another toy block to make a contact with the long wall at a depression and at least one of the four lateral walls facing the middle partition; and wherein the depression comprises a trapezoidal shape with legs having a gentler slope than a curvature of the cylindrical shape so that the depression is configured to contact the at least one cylindrical projection at a line of maximal depression.

9. The toy block according to claim 8, wherein the middle partition further comprises a short wall, wherein the long wall, longer than the short wall and orthogonal to the short wall, comprises the depression.

* * * * *